US009268284B2

(12) United States Patent
Yokoyama et al.

(10) Patent No.: US 9,268,284 B2
(45) Date of Patent: Feb. 23, 2016

(54) IMAGE FORMING DEVICE AND CONTROL METHOD FOR IMAGE FORMING DEVICE

(71) Applicants: Takuhei Yokoyama, Osaka (JP); Yoshinori Shirasaki, Osaka (JP); Tatsuya Miyadera, Osaka (JP); Masayuki Hayashi, Osaka (JP); Kunihiro Komai, Osaka (JP); Motohiro Kawanabe, Osaka (JP); Hiroaki Ikeda, Osaka (JP); Takeshi Shikama, Osaka (JP); Akinori Yamaguchi, Osaka (JP)

(72) Inventors: Takuhei Yokoyama, Osaka (JP); Yoshinori Shirasaki, Osaka (JP); Tatsuya Miyadera, Osaka (JP); Masayuki Hayashi, Osaka (JP); Kunihiro Komai, Osaka (JP); Motohiro Kawanabe, Osaka (JP); Hiroaki Ikeda, Osaka (JP); Takeshi Shikama, Osaka (JP); Akinori Yamaguchi, Osaka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 13/761,747

(22) Filed: Feb. 7, 2013

(65) Prior Publication Data

US 2013/0207339 A1 Aug. 15, 2013

(30) Foreign Application Priority Data

Feb. 13, 2012 (JP) ..... 2012-028819

(51) Int. Cl.
*G03G 15/00* (2006.01)

(52) U.S. Cl.
CPC ..... *G03G 15/602* (2013.01); *G03G 15/657* (2013.01); *G03G 2215/00599* (2013.01); *G03G 2215/00746* (2013.01); *G03G 2215/00772* (2013.01)

(58) Field of Classification Search
CPC ..... G03G 15/0194; G03G 15/011; G03G 15/041; G03G 15/0415; G03G 15/043; G03G 15/6558; G03G 2215/0478; G03G 15/657; G03G 2215/00599; G03G 2216/00772; G03G 2215/00746
USPC ..... 271/265.01; 399/301, 394, 396, 68
See application file for complete search history.

(56) References Cited

U.S. PATENT DOCUMENTS 4,618,242 A * 10/1986 Yamagishi ..... 399/45
5,170,215 A * 12/1992 Pfeuffer ..... 399/68

(Continued)

FOREIGN PATENT DOCUMENTS

JP 2004-338894 12/2004
JP 2005-331577 12/2005

(Continued)

*Primary Examiner* — Jeremy R Severson
(74) *Attorney, Agent, or Firm* — Oblon, McClelland, Maier & Neustadt, L.L.P.

(57) ABSTRACT

According to an embodiment, provided is an image forming device that includes: an image forming unit forming an image in a predetermined cycle in a direction orthogonal to a conveying direction of a printing medium; a velocity acquisition unit acquiring a conveying velocity of the printing medium at a position where the image is formed by the image forming unit; and a correcting unit correcting the cycle on which the image forming unit forms the image in accordance with the conveying velocity acquired by the velocity acquisition unit.

16 Claims, 14 Drawing Sheets

(56) References Cited

U.S. PATENT DOCUMENTS

| | | | | |
|---|---|---|---|---|
| 6,567,624 | B1 * | 5/2003 | Murata | 399/69 |
| 6,872,018 | B2 * | 3/2005 | Jung | 400/578 |
| 7,054,571 | B2 * | 5/2006 | Camp et al. | 399/68 |
| 7,600,754 | B2 * | 10/2009 | Sato | 271/270 |
| 7,848,696 | B2 * | 12/2010 | Peng et al. | 399/395 |
| 8,626,041 | B2 * | 1/2014 | Tominaga et al. | 399/301 |
| 8,878,885 | B2 * | 11/2014 | Miyadera | 347/234 |
| 2002/0164173 | A1 * | 11/2002 | Osada | 399/45 |
| 2008/0252713 | A1 * | 10/2008 | Horikawa | 347/237 |
| 2009/0129797 | A1 | 5/2009 | Suzuki et al. | |
| 2009/0208229 | A1 * | 8/2009 | Takagi et al. | 399/43 |
| 2010/0278550 | A1 * | 11/2010 | Chiba et al. | 399/66 |
| 2011/0085827 | A1 | 4/2011 | Tominaga et al. | |

FOREIGN PATENT DOCUMENTS

| | | |
|---|---|---|
| JP | 2006-267189 | 10/2006 |
| JP | 2008-233858 | 10/2008 |
| JP | 2009-053612 | 3/2009 |
| JP | 2009-067561 | 4/2009 |
| JP | 2011-081270 | 4/2011 |

* cited by examiner

IMAGE FORMING DEVICE AND CONTROL METHOD FOR IMAGE FORMING DEVICE

CROSS-REFERENCE TO RELATED APPLICATIONS

The present application claims priority to and incorporates by reference the entire contents of Japanese Patent Application No. 2012-028819 filed in Japan on Feb. 13, 2012.

BACKGROUND OF THE INVENTION

1. Field of the Invention

The present invention relates to an image forming device for forming an image on a printing medium conveyed using a roller, and to a control method for the image forming device.

2. Description of the Related Art

A technique for an image forming device of electrophotography has been known in which a static charge formed on a photosensitive drum is exposed to a laser beam to form an electrostatic latent image based on image data; a toner image is formed by developing the electrostatic latent image with a developing agent; and this toner image is fixed on a printing medium using a fixing roller, thereby performing image formation on the printing medium. The printing medium is conveyed by being absorbed on a conveying belt through electrostatic absorption, for example, and reaches the fixing roller while toner images of four colors are overlapped on each other via photosensitive drums of C, M, Y, and K colors.

The type, in which the toner image is directly formed on the printing medium from the photosensitive drum, is called a direct transfer type. Meanwhile, the type, in which the toner image is formed on an intermediate transfer belt from the photosensitive drum and the toner image formed on the intermediate transfer belt is secondarily transferred to the printing medium, is called an intermediate transfer type.

The photosensitive drum is generally made of metal, and its allowance or thermal change in diameter is relatively small; therefore, variation in linear velocity is also small. Meanwhile, the fixing roller is generally formed using an elastic rubber material because the amount of fixing is large particularly in the case of overlapping the four colors as above. Accordingly, the allowance or the thermal change in diameter of the fixing roller is larger than that of the photosensitive drum; thus, the variation in linear velocity is also larger than that of the photosensitive drum.

Here, when linear velocity difference is caused between the photosensitive drum and the fixing roller, for example, in the aforementioned direct transfer type, the conveyance of the printing medium is affected by this linear velocity difference. For example, when the printing medium is pulled by the fixing roller to make the linear velocity difference between the photosensitive drum and the fixing roller, the conveying velocity changes depending on this linear velocity difference. Therefore, the velocity of the printing medium and the linear velocity of the photosensitive drum (that is, the linear velocity of an image forming unit) does not match with each other, thus leading to deviation of an image formed on the printing medium from an original image in a conveying direction (sub-scanning direction). This deviation is caused by the change of the interval of main scanning in accordance with the ratio between the linear velocity of the fixing roller and the linear velocity of the photosensitive drum, and is called sub-scanning magnification deviation below.

To suppress such magnification deviation in the sub-scanning direction, Japanese Patent Application Laid-open No. 2009-067561 has disclosed a configuration in which a helical gear is used for a roller driving system. Moreover, Japanese Patent Application Laid-open No. 2011-081270 has disclosed a technique for detecting the circumferential velocity of a fixing roller or an intermediate belt and correcting each linear velocity by controlling a driving motor of the fixing roller or the intermediate belt based on the detection result.

However, the method disclosed in Japanese Patent Application Laid-open No. 2009-067561 has had a problem in that the number of gears is increased because of the use of the helical gear, which makes the configuration of the roller driving system complicated. Further, the increase in number of gears increases the torque and the consumption power.

Moreover, the method disclosed in Japanese Patent Application Laid-open No. 2011-081270 has had a problem in that it takes time to match the linear velocities of the respective units; and in the case of the intermediate transfer type, it has been difficult to deal with quick control, for example, for correcting the sub-scanning magnification deviation caused when a printing medium passes through a secondary transfer unit and the fixing roller. This corresponds to, in the case of the direct transfer type, the state in which the printing medium passing through the fixing roller is subjected to the transfer also simultaneously on a rear end side, and is a problem also occurring in the direct transfer type.

There is a need to correct, with a simpler configuration, the magnification deviation in the sub-scanning direction in the case where the conveying velocity of the printing medium changes relative to the linear velocity of the image forming unit.

SUMMARY OF THE INVENTION

It is an object of the present invention to at least partially solve the problems in the conventional technology.

According to an embodiment, provided is an image forming device that includes: an image forming unit forming an image in a predetermined cycle in a direction orthogonal to a conveying direction of a printing medium; a velocity acquisition unit acquiring a conveying velocity of the printing medium at a position where the image is formed by the image forming unit; and a correcting unit correcting the cycle on which the image forming unit forms the image in accordance with the conveying velocity acquired by the velocity acquisition unit.

According to another embodiment, provided is a control method for an image forming device. The method includes: image forming that includes forming an image in a predetermined cycle in a direction orthogonal to a conveying direction of a printing medium by an image forming unit; velocity acquiring that includes acquiring a conveying velocity of the printing medium at a position where the image is formed at the image forming, by a velocity acquiring unit; and correcting that includes correcting the cycle on which the image is formed at the image forming in accordance with the conveying velocity acquired at the velocity acquiring, by a correcting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

With reference to attached drawings, embodiments of an image forming device and a control method for the image forming device are specifically described below.

First Embodiment

Figure 1:
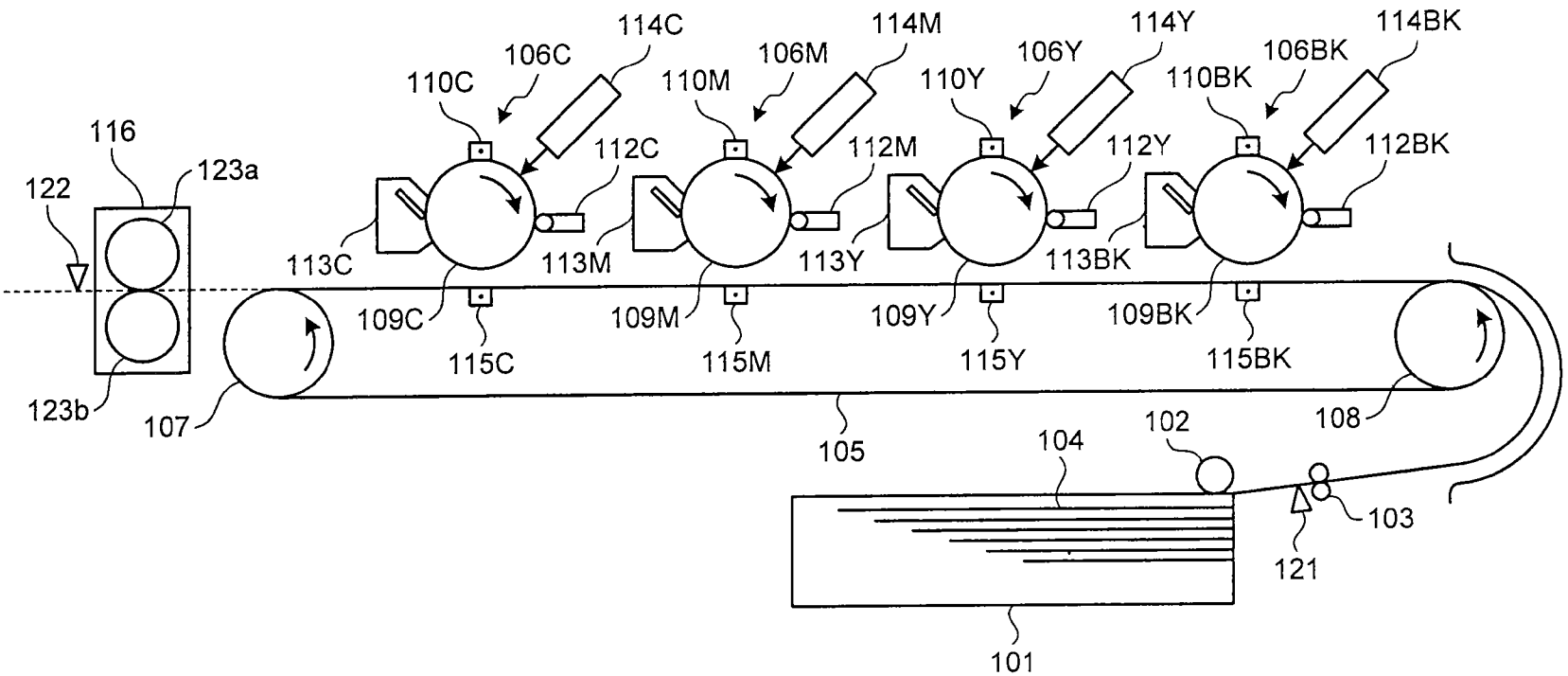
FIG. 1 is a schematic diagram basically illustrating a unit performing image formation in a configuration of an example of an image forming device according to a first embodiment.

FIG. 1 illustrates mainly a unit performing the image formation in the configuration of an example of an image forming device according to a first embodiment. The image forming device illustrated in FIG. 1, which is called a tandem type, includes image forming units 106C, 106M, 106Y, and 106BK forming images of colors of C (Cyan), M (Magenta), Y (Yellow), and BK (Black), respectively which are arranged along a conveying belt 105 as an endless moving unit. This first embodiment is an example of a direct transfer type image forming device for directly transferring an image from a photosensitive drum, which has been subjected to light exposure in accordance with image data, to a printing medium.

In the image forming device according to the first embodiment, the image forming units 106BK, 106Y, 106M, and 106C are arranged in this order from the upstream side in a conveying direction of the conveying belt 105 which conveys a sheet of paper (printing medium) 104 separated and fed by a paper feeding roller 102 and separating rollers 103 from a paper cassette 101 along the conveying belt 105. These image forming units 106BK, 106Y, 106M, and 106C have common inner configurations except that the colors of the toner images to be formed are different.

That is, for example, the image forming unit 106BK includes a photosensitive drum 109BK, a charger 110BK, a developer 112BK, an electrification eliminator 113BK, and an LEDA (light-emitting diode array) head 114BK, and also has a transferring unit 115BK at a position that faces the conveying belt 105 with respect to the photosensitive drum 109BK.

Similarly, the image forming units 106Y, 106M, and 106C include: a photosensitive drum 109Y, a photosensitive drum 109M, and a photosensitive drum 109C; a charger 110Y, a charger 110M, and a charger 110C; a developer 112Y, a developer 112M, and a developer 112C; an electrification eliminator 113Y, an electrification eliminator 113M, an electrification eliminator 113C; and an LEDA head 114Y, an LEDA head 114M, and an LEDA head 114C, respectively. Further, the image forming units 106Y, 106M, and 106C have transferring units 115Y, 115M, and 115C at positions that face the conveying belt 105 with respect to the photosensitive drum 109Y, the photosensitive drum 109M, and the photosensitive drum 109C, respectively.

For avoiding the complication, the description is hereinafter made of the image forming unit 106BK representing the image forming units 106BK, 106Y, 106M, and 106C. Moreover, the description is made of a photosensitive drum 109 representing the photosensitive drums 109C, 109M, 109Y, and 109BK unless they need to be particularly discriminated.

The conveying belt 105 is an endless belt wound around a driving roller 107 and a driven roller 108, which are rotated and driven. This driving roller 107 is rotated and driven by a driving motor, which is not shown, and this driving motor, the driving roller 107, and the driven roller 108 function as a driving unit for moving the conveying belt 105.

In the image formation, sheets of paper 104 housed in the paper cassette 101 are sent in the order from the uppermost sheet by the paper feeding roller 102, and are sent into the separating rollers 103 after the tip of the paper is detected by a registration sensor 121 for positioning the paper 104. The paper 104 reaches the conveying belt 105 after being sent from the separating rollers 103, and is absorbed on the conveying belt 105 by an electrostatic absorption effect. Then, the paper 104 is conveyed to the first image forming unit 106BK by the conveying belt 105 which is rotated and driven, where the black toner image is transferred.

The image forming unit 106BK includes the photosensitive drum 109BK as a photosensitive element, the charger 110BK disposed around the photosensitive drum 109BK, the LEDA head 114BK, the developer 112BK, a photosensitive element cleaner (not shown), and the electrification eliminator 113BK. The LEDA head 114BK is formed by, for example, arranging a number of light-emitting diodes so that the photosensitive drum 109BK is irradiated with a linear light beam in a main-scanning direction.

In the image formation, the outer peripheral surface of the photosensitive drum 109BK is charged uniformly by the charger 110BK in the darkness, and then is exposed to irradiation light corresponding to the image data of the color BK from the LEDA head 114BK, whereby an electrostatic latent image is formed. The developer 112BK visualizes this electrostatic latent image by the black toner. Thus, the black toner image is formed on the photosensitive drum 109BK.

Here, the exposure for one line is performed on the photosensitive drum 109BK with one time of lighting of the LEDA head 114BK, and one scanning in the main-scanning direction is performed. By lighting the LEDA head 114BK according to a predetermined cycle while rotating the photosensitive drum 109BK at a predetermined angular velocity, the exposure of each line at equal intervals is performed.

The toner image formed on the photosensitive drum 109BK is transferred onto the paper 104 by the operation of the transferring unit 115BK at a position where the photosensitive drum 109BK and the paper 104 on the conveying belt 105 are in contact with each other (transfer position). By this transferring, the image by the black toner is formed on the paper 104.

The unnecessary toner remaining on the outer peripheral surface of the photosensitive drum 109BK after the completion of the transfer of the toner image is removed by the photosensitive element cleaner, and the electrification is eliminated by the electrification eliminator 113BK; then, the photosensitive drum stands-by for the next image formation.

The paper 104 to which the black toner image has been transferred in the image forming unit 106BK in this manner is conveyed to the next image forming unit 106Y by the conveying belt 105. In the image forming unit 106Y, the yellow toner image is formed on the photosensitive drum 109Y through the process similar to the aforementioned image forming process in the image forming unit 106BK, and the toner image is overlapped on the black image formed on the paper 104. The paper 104 is sequentially conveyed to the next image forming units 106M and 106C, and through the similar process, the magenta toner image formed on the photosensitive drum 109M and the cyan toner image formed on the photosensitive drum 109C are overlapped and transferred to the paper 104 sequentially. Thus, the full-color image is formed on the paper 104.

The paper 104 on which the full-color image has been formed is separated from the conveying belt 105 and sent to a fixer 116. The fixer 116 includes a fixing roller 123*a* and a pressing roller 123*b* in contact with the fixing roller 123*a*. The pressing roller 123*b* applies a predetermined amount of pressure to the fixing roller 123*a*. The fixing roller 123*a* is controlled to be heated at a constant temperature by a heater which is not shown. At least one of the fixing roller 123*a* and the pressing roller 123*b* is rotated and driven at an angular velocity corresponding to the conveying velocity of the conveying belt 105.

The paper 104 is heated and pressured when the paper passes through the fixer 116 between the fixing roller 123*a* and the pressing roller 123*b*. By being heated and pressured thus, the toner images of the colors on the paper 104 are fixed on the paper 104. A tip of the paper 104 discharged from the fixer 116 is detected by a discharging sensor 122, which detects the presence of the paper 104 by using the reflection of light, for example; and then the paper 104 is discharged.

Summary of the First Embodiment

Here, a case is considered in which there is a difference between the linear velocity (conveying velocity) of the conveying belt 105 and the linear velocity of the fixer 116. In this case, when the image is formed on the paper 104 in the image forming unit (for example, image forming unit 106C) during the passage of the paper 104 through the fixer 116, the image extending or contracting according to the magnification based on the ratio of the conveying velocities before and after the reach of the paper 104 at the fixer 116 in the conveying direction (sub-scanning direction) is formed on the paper 104. This extension or contraction of the image at the magnification in the sub-scanning direction is called sub-scanning magnification deviation.

In view of this, in this first embodiment, the sub-scanning magnification deviation is corrected by changing the exposure timing of the LEDA head in accordance with the conveying velocity at the image forming position. This correction is called sub-scanning magnification correction.

More specifically, the period where the image is formed by the image forming unit during the passage of the paper 104 through the fixer 116 is obtained. Then, the conveying velocity in this period is obtained; and based on the obtained conveying velocity, the cycle of main scanning in the image forming unit in the period is corrected. In this first embodiment, the exposure timing of the LEDA head of the image forming unit is changed using as a correction value, the ratio (linear velocity ratio) between the linear velocity of the photosensitive drum 109 and the linear velocity of the fixing roller 123*a* of the fixer 116. This corrects the extension or contraction of the image at the magnification according to the velocity ratio in the sub-scanning direction.

In this case, the linear velocity of the fixing roller 123*a* is considered as the conveying velocity of the paper 104 at the position of the image forming unit in the case where the image formation is performed in the image forming unit on the paper 104 during the passage of the paper 104 through the fixer 116. Meanwhile, the conveying velocity of the conveying belt 105 can be considered as the conveying velocity of the paper 104 at the position of the image forming unit before the paper 104 reaches the fixer 116. The conveying velocity of the conveying belt 105 corresponds to the linear velocity of the photosensitive drum 109.

Here, a case is considered in which the size of the paper 104 in the conveying direction is the size ranging from the position of the fixing roller 123*a* to an intermediate position between the image forming unit 106C and the image forming unit 106M. In this case, only the image forming unit 106C among the image forming units 106C, 106M, 106Y, and 106BK can form the image during the passage of the paper 104 through the fixer 116. However, at the position of the image forming unit 106C, the color images are already formed by the image forming units 106M, 106Y, and 106BK. Therefore, changing the exposure timing needs to be performed not just for the image forming unit 106C but also for the image forming units 106C, 106M, 106Y, and 106BK.

Detailed Description of First Embodiment

Figure 2:
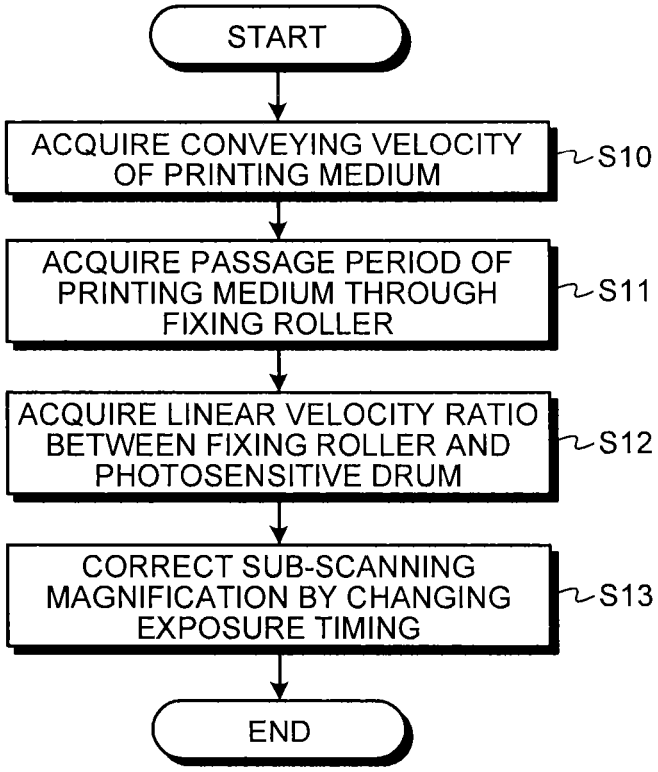
FIG. 2 is a flow chart of an example schematically illustrating the sub-scanning magnification correction processing according to the first embodiment.

FIG. 2 is a flow chart of an example schematically illustrating the sub-scanning magnification correction processing according to the first embodiment. In the image forming device, first, the conveying velocity of the paper 104 is obtained in Step S10. The conveying velocity of the paper 104 can be obtained based on the output of the registration sensor 121 and the discharging sensor 122 and on the known distance between the registration sensor 121 and the discharging sensor 122. Alternatively, the driving velocity of the conveying belt 105 may be acquired and used as the conveying velocity.

The image forming device obtains the passage period where the paper 104 passes the fixing roller 123*a* in the next Step S11. The passage period can be obtained from the conveying velocity of the paper 104, which is obtained in Step S10, the output of the registration sensor 121, and the size of the paper 104 in the conveying direction. Alternatively, the passage period may be obtained from the output of the registration sensor 121, the output of the discharging sensor 122, and the size of the paper 104 in the conveying direction.

Next, the image forming device obtains the linear velocity ratio between the linear velocity of the fixing roller 123*a* and the linear velocity of the photosensitive drum 109 in Step S12. Note that the linear velocity of the fixing roller 123*a* refers to the velocity in a tangential direction at a portion where the fixing roller 123*a* is in contact with the paper 104. The linear velocity of the photosensitive drum is the velocity of the photosensitive drum 109 in a direction orthogonal to the rotation axis thereof in a portion where the photosensitive drum 109 faces the paper 104. Note that the linear velocity of the fixing roller 123*a* corresponds to the conveying velocity of the paper 104 conveyed by the fixing roller 123*a*, and the linear velocity of the photosensitive drum 109 corresponds to the conveying velocity of the conveying belt 105.

In the next Step S13, the image forming device corrects the sub-scanning magnification based on the passage period obtained in Step S10 and Step S11, and the linear velocity ratio between the fixing roller 123*a* and the photosensitive drum 109 obtained in Step S12. In other words, the image forming device obtains the period where the image formation is performed while the paper 104 passes the fixing roller 123*a* based on the passage period. Then, in this period, the image forming device changes the exposure timings of the LEDA heads 114C, 114M, 114Y, and 114BK to the photosensitive drums 109C, 109M, 109Y, and 109BK based on the linear velocity ratio, and corrects the sub-scanning magnification.

Acquisition of Correction Period

Figure 3:
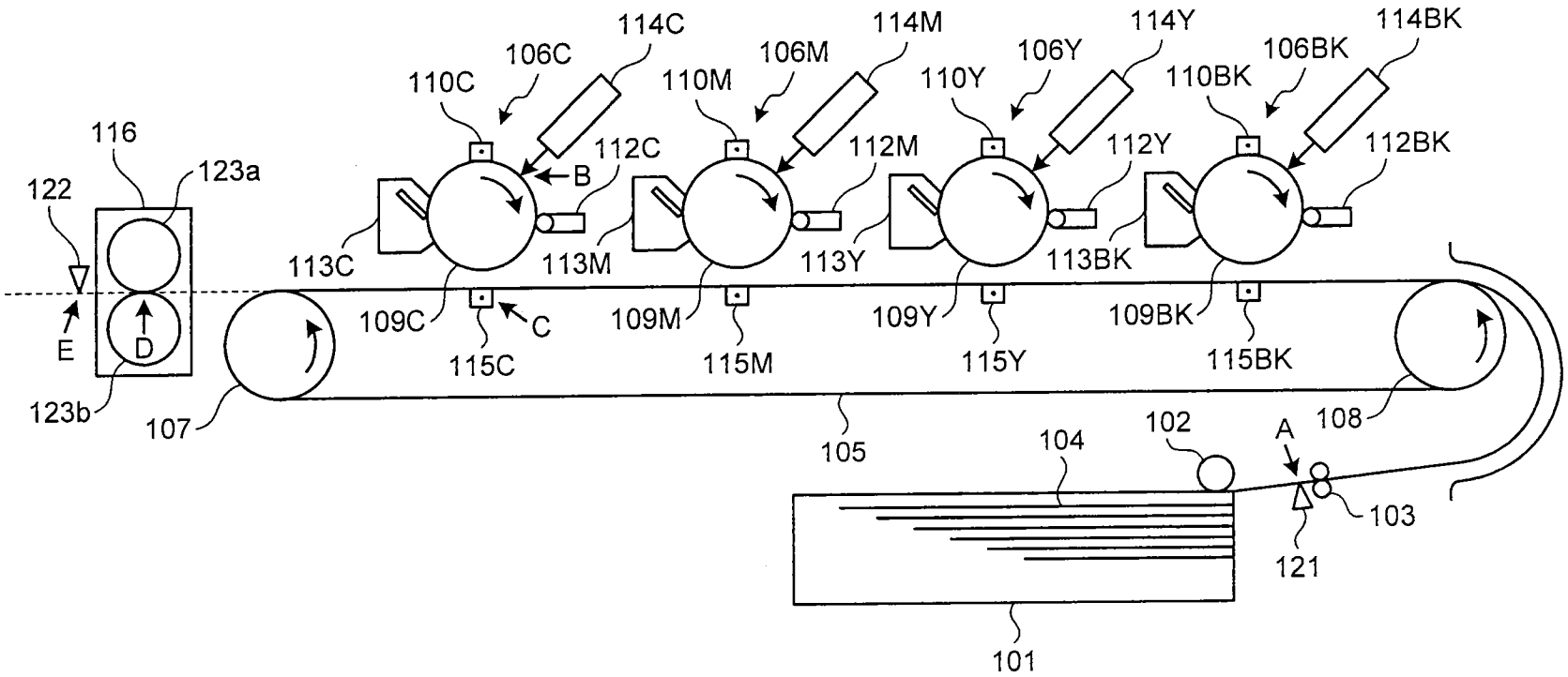
FIG. 3 is a schematic diagram for describing the relation between the position of paper and the position of an image according to the first embodiment.

How to acquire the conveying velocity of the paper 104 and the passage period through the fixing roller 123*a* in Step S10 and Step S11 in the flow chart of FIG. 2 described above is described with reference to FIG. 3 and (a) and (b) in FIG. 4. First, the relation between the image position and the position of the paper 104 in the image forming device is schematically described using FIG. 3. The component of FIG. 3 common to that of FIG. 1 above is denoted with the same reference symbol and the detailed description thereof is omitted.

The paper 104 is extracted from the paper cassette 101 by the paper feeding roller 102, and sent to the separating rollers 103. At this time, the tip of the paper 104 is detected by the registration sensor 121 provided at a position A just before the separating rollers 103. The output of the registration sensor 121 is in an H state while the paper 104 is detected, and is in an L state during the absence of the paper 104.

The paper 104 is sent from the separating rollers 103; reaches the conveying belt 105; and is conveyed on the conveying belt 105. Upon the reach of the paper 104 at the position of the driving roller 107, the paper 104 is separated from the conveying belt 105 and sent into the fixer 116. The paper 104 is discharged after passing the fixing roller 123*a* at a position D in the fixer 116. On this occasion, the tip of the paper 104 is detected by the discharging sensor 122 provided at a position E on the discharge side of the fixer 116. In a manner similar to the aforementioned registration sensor 121, the discharging sensor 122 is also in an H state while the paper 104 is detected, and is in an L state during the absence of the paper 104.

On the other hand, for example in the image forming unit 106C, light exposure is performed in a manner that a position B of the photosensitive drum 109C that faces the conveying belt 105 with respect to the rotation axis of the photosensitive drum 109C in this example is irradiated with a light beam from the LEDA head 114C. The photosensitive drum 109C is rotated so that the exposed part is developed, and then reaches the conveying belt 105. At a position C corresponding to the transferring unit 115C, the transfer of the exposed image to the paper 104 is performed.

Figure 4:
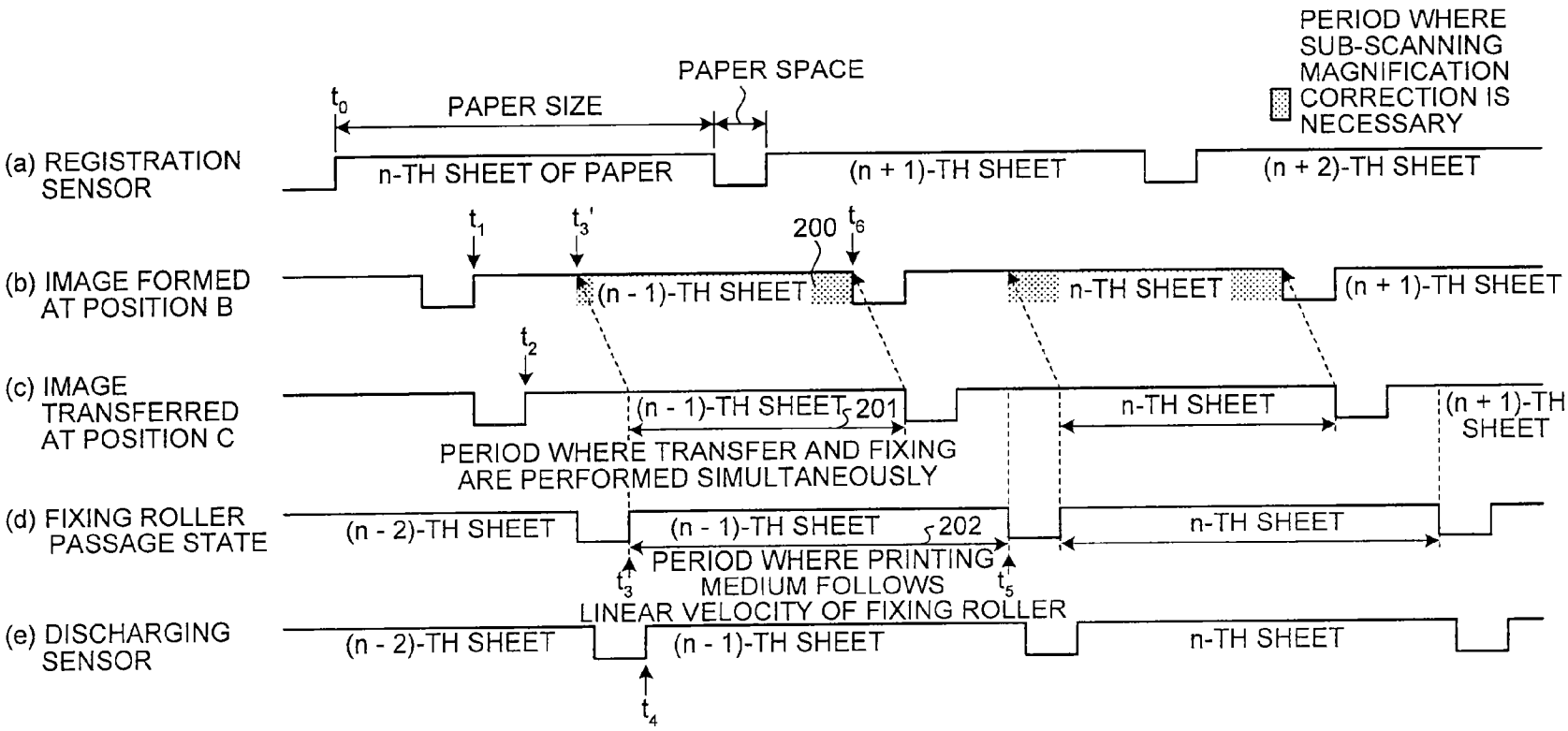
FIG. 4 is a schematic diagram illustrating time-sequentially the state of an example of each position in the conveyance of paper according to the first embodiment.

(a) to (e) in FIG. 4 illustrate an example of the conveyance of the paper 104 along the positions A to E time-sequentially. This example illustrates the continuous conveyance in which a plurality of sheets of paper 104 including a (n−2)-th sheet, an (n−1)-th sheet, an n-th sheet . . . are spaced from each other with predetermined intervals (called paper space). In this description, it is assumed that the paper size in the conveying direction of the paper 104 is the same as the size of an image region to which the image is transferred to the paper 104 in the conveying direction. Moreover, description is hereinafter made paying attention to the image formation in the image forming unit 106C.

(a) in FIG. 4 illustrates an example of the state of the paper 104 at the position A, i.e., the output of the registration sensor 121. In the H state, the paper 104 is detected by the registration sensor 121. FIG. 4B indicates the timing at which the exposure to the photosensitive drum 109C is performed to form the image at the position B. FIG. 4C indicates the timing at which the image formed at the position B is transferred to the paper 104 at the position C. FIG. 4D indicates the timing at which the paper 104 passes the position D, i.e., passes the fixing roller 123*a*. (e) in FIG. 4 indicates the timing at which the paper 104 is detected by the discharging sensor 122.

At a time point $t_0$ at which the tip of the n-th sheet of paper 104 is detected by the registration sensor 121, the image formation on the (n−2)-th sheet of paper 104 at the position B and the transfer to the (n−2)-th sheet of paper 104 at the position C are already performed; moreover, a part of this (n−2)-th sheet of paper 104 already passes the position D and another part of the (n−2)-th sheet of paper 104 passes the position E and is discharged. After the n-th sheet of paper 104, the registration sensor 121 sequentially detects (n+1)-th, (n+2)-th, . . . sheets of paper 104.

Upon the completion of the image formation on the (n−2)-th sheet of paper 104 at the position B, the image formation for the next (n−1)-th sheet of paper 104 is started at a time point $t_1$ after a time corresponding to the paper space. The photosensitive drum 109C is rotated at the linear velocity corresponding to the conveying velocity of the conveying belt 105, and at the position C, the transfer of the formed image onto the (n−1)-th sheet of paper 104 is started at a time point $t_2$.

The (n−1)-th sheet of paper 104 is conveyed to the conveying belt 105 while the image is transferred at the position C, and sent into the fixing roller 123*a* at a time point $t_3$ and reaches the position D. At a time point $t_4$ just after that, the sheet reaches the position E and is detected by the discharging sensor 122.

Here, in the case where the distance from the position C to the position D is shorter than the paper size of the paper 104, the image is transferred to the (n−1)-th sheet of paper 104 at the position C at the time point $t_3$ at which the (n−1)-th sheet of paper 104 has reached the position D. That is, the (n−1)-th sheet of paper 104 in the middle of image transfer is conveyed at the linear velocity of the fixing roller 123*a* in a period 202 from the time point $t_3$ to a time point $t_5$ at which an end of the paper 104 passes the fixing roller 123*a*. Therefore, if the linear velocity of the fixing roller 123*a* and the conveying velocity of the conveying belt 105 (that is, the linear velocity of the photosensitive drum 1090) are different, the line intervals of the image transferred to the photosensitive drum 109C are different from the original line intervals in a period 201 where the image transfer and the fixing by the fixing roller

123*a* are simultaneously performed, resulting in the occurrence of the sub-scanning magnification deviation.

Therefore, it is necessary to correct the sub-scanning magnification deviation from a time point $t_3'$, which is before the time point $t_3$ by the time of the rotation of the photosensitive drum 109C from the position B to the position C and at which the exposure of the image to be transferred at the time point $t_3$ is performed. As a result, a period 200 from the time point $t_3'$ to a time point $t_6$ at which the image region ends in the photosensitive drum 109C corresponds to the period in which the sub-scanning magnification correction is necessary.

The time point $t_3$ can be obtained from the timing at which the paper 104 is detected by the registration sensor 121. For example, the time point $t_3$ for each paper 104 is estimated based on the conveying velocity of the conveying belt 105 and the conveyance distance from the registration sensor 121 to the position D (fixing roller 123*a*), which are the known information. Similarly, since the time of the rotation of the photosensitive drum 109C from the position B to the position C is also known, the time point $t_3'$ as the timing of starting the correction can be estimated from the time point $t_3$.

The time point $t_3$ may be estimated by measuring the time Δt from the detection by the registration sensor 121 to the detection by the discharging sensor 122. That is, the time point $t_3$ for the n-th sheet of paper 104 is estimated by measuring the time Δt for the (n−1)-th sheet of paper 104 and using the measured time Δt, the distance between the registration sensor 121 and the discharging sensor 122, and the distance between the position C and the position D of the fixing roller 123*a*, which are the known information. Although the conveying velocity of the paper 104 changes when the paper 104 passes the fixing roller 123*a*, the change in conveying velocity can be ignored by setting the distance from the fixing roller 123*a* to the discharging sensor 122 short.

Here, the images of the colors C, M, Y, and BK are formed on the paper 104 while the images are positioned and overlapped on each other. Therefore, a period where the sub-scanning magnification correction is necessary is provided for each of the photosensitive drums 109C, 109M, 109Y, and 109BK of the colors C, M, Y, and BK. The periods for the photosensitive drums 109M, 109Y, and 109BK are provided while the periods are shifted from the above period 200 provided for the photosensitive drum 109C in accordance with each position and the conveying velocity of the conveying belt 105.

Acquisition of Linear Velocity Ratio

Next, how to acquire the linear velocity ratio between the fixing roller 123*a* and the photosensitive drum 109 in Step S12 in the flow chart of FIG. 2 is described. In this first embodiment, the linear velocity ratio is obtained based on the temperature change of the fixing roller 123*a*.

As aforementioned, the fixing roller 123*a* heats and pressures the paper 104 for fixing to the paper 104 the toner images formed on the paper 104 in the image forming units 106C, 106M, 106Y, and 106BK. The fixing roller 123*a* is thermally deformed because of being formed using an elastic material such as a rubber material or a sponge material, and its linear velocity changes according to the deformation amount. Meanwhile, the degree of deformation of the photosensitive drum 109 formed using metal is much smaller than that of the fixing roller 123*a*, and the variation in linear velocity is extremely small.

Figure 5:
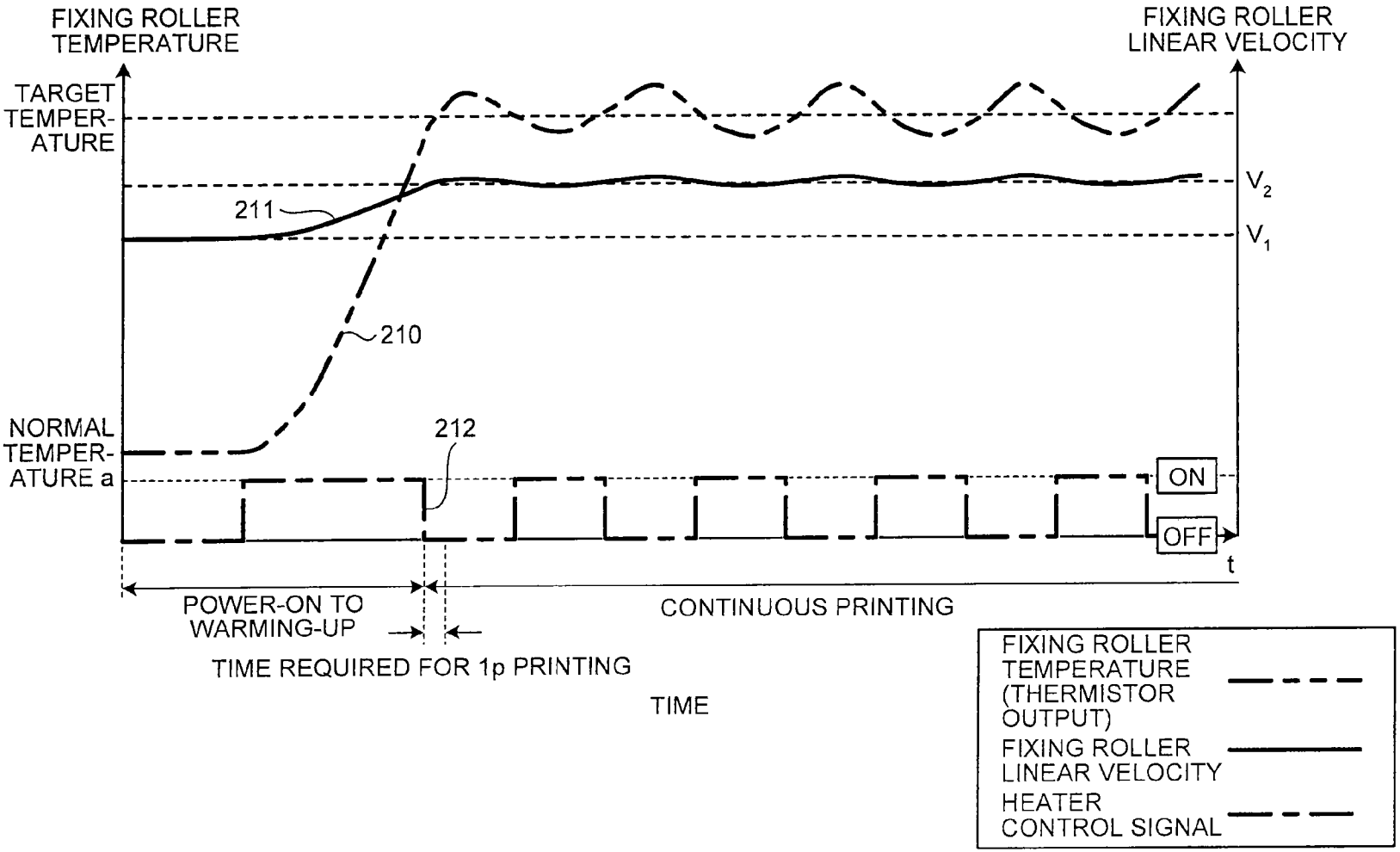
FIG. 5 is a schematic diagram illustrating an example of the relation between the temperature and the linear velocity of the fixing roller.

FIG. 5 represents an example of the relation between the temperature and the linear velocity of the fixing roller 123*a*. In FIG. 5, the horizontal axis represents the time. A curved line 210 represents the temperature of the fixing roller 123*a*, and a curved line 211 represents the linear velocity. A line 212 represents a heater control signal for controlling the temperature of the fixing roller 123*a*. The heater is on while the line 212 is in the H state and is off while the line 212 is in the L state.

In the figure, a value $V_1$ represents the linear velocity of the fixing roller 123*a* at normal temperature. This value $V_1$ is hereinafter called a reference linear velocity $V_1$. The reference linear velocity $V_1$ is adjusted by the output of the discharging sensor 122 in advance when a sheet of a printing medium is passed at normal temperature so that the reference linear velocity $V_1$ does not vary even though the outer diameter of the fixing roller 123*a* has an allowance, whereby the reference linear velocity $V_1$ corresponds to the linear velocity of the photosensitive drum 109. The adjustment of the reference linear velocity $V_1$ is performed in an assemble factory for each image forming device or performed by providing a special mode in the image forming device.

The temperature of the fixing roller 123*a* is controlled by the ON/OFF of the heater. As indicated by the line 212 and the curved line 210 in FIG. 5, the temperature of the fixing roller 123*a* reaches the target temperature in a warm-up period since the power is turned on, and then follows the ON/OFF control of the heater while awaiting the overshooting or undershooting. Note that the time required for printing one sheet of paper 104 (one page) is shorter than the ON/OFF period of the heater. As indicated by the curved line 211 in the example of FIG. 5, the linear velocity of the fixing roller 123*a* is increased as the temperature of the fixing roller 123*a* is increased.

More specific description is made on the change in linear velocity of the fixing roller 123*a* due to thermal expansion. The linear velocity (reference velocity $V_1$) at normal temperature of the fixing roller 123*a* with a rotation velocity of $V_r$ and a diameter of $r_a$ at normal temperature is expressed by the following formula (1):

$$V_1=2\pi r_a V_r \tag{1}$$

For simplicity, a model including only a surface of the fixing roller 123*a* is used. The fixing roller 123*a* has a coefficient of thermal expansion of ρ, and when the temperature changes from normal temperature a to a temperature of b, the outer diameter 1 of the fixing roller 123*a* at a temperature of a+b is expressed by the formula (2). Therefore, referring to the formula (1), the linear velocity $V_{a+b}$ of the fixing roller 123*a* at a temperature of a+b is expressed by the formula (3).

$$l=2\pi r_a+2\pi r_a\times b\rho=2\pi r_a(1+b\rho) \tag{2}$$

$$V_{a+b}=2\pi r_a V_r(1+b\rho) \tag{3}$$

Meanwhile, since the linear velocity of the photosensitive drum 109 is equal to the reference linear velocity $V_1$, the linear velocity ratio A between the fixing roller 123*a* and the photosensitive drum 109 at a temperature of a+b is expressed by the following formula (4). Therefore, the linear velocity ratio A can be obtained by the temperature change and the coefficient of thermal expansion ρ not depending on the diameter of the fixing roller 123*a*.

$$A=2\pi r_a V_r(1+b\rho)/2\pi r_a V_r=1/(1+b\rho) \tag{4}$$

The formula (3) indicates that the linear velocity of the fixing roller 123*a* is in proportion to the temperature change. That is, the linear velocity $V_{a+b}$ of the fixing roller 123*a* at a temperature of a+b is expressed by the following formula (5). This linear velocity $V_{a+b}$ is expressed as the target linear velocity $V_2$ in FIG. 5.

$$V_{a+b}=V_{1\rho}b\ V_1 \tag{5}$$

Sub-Scanning Magnification Correction Processing

Next, sub-scanning magnification correction processing in Step S13 in the flow chart of FIG. 2 is described. In accordance with the linear velocity ratio A between the fixing roller 123*a* and the photosensitive drum 109 obtained in the processing of Step S12, the sub-scanning magnification correction processing is performed by changing the exposure timing of the LEDA heads 114C, 114M, 114Y, and 114BK in the passage period obtained in Step S11 where the paper 104 passes the fixing roller 123*a*.

More specifically, in the case where the exposure timing when the fixing roller 123*a* has normal temperature is set as an interval $f_0$, the exposure timing after the change is obtained by the following formula (6) using the linear velocity ratio A. In the formula (6), the value $f_1$ indicates the interval by the exposure timing after the change.

$$f_1 = f_0/A \tag{6}$$

Figure 6:
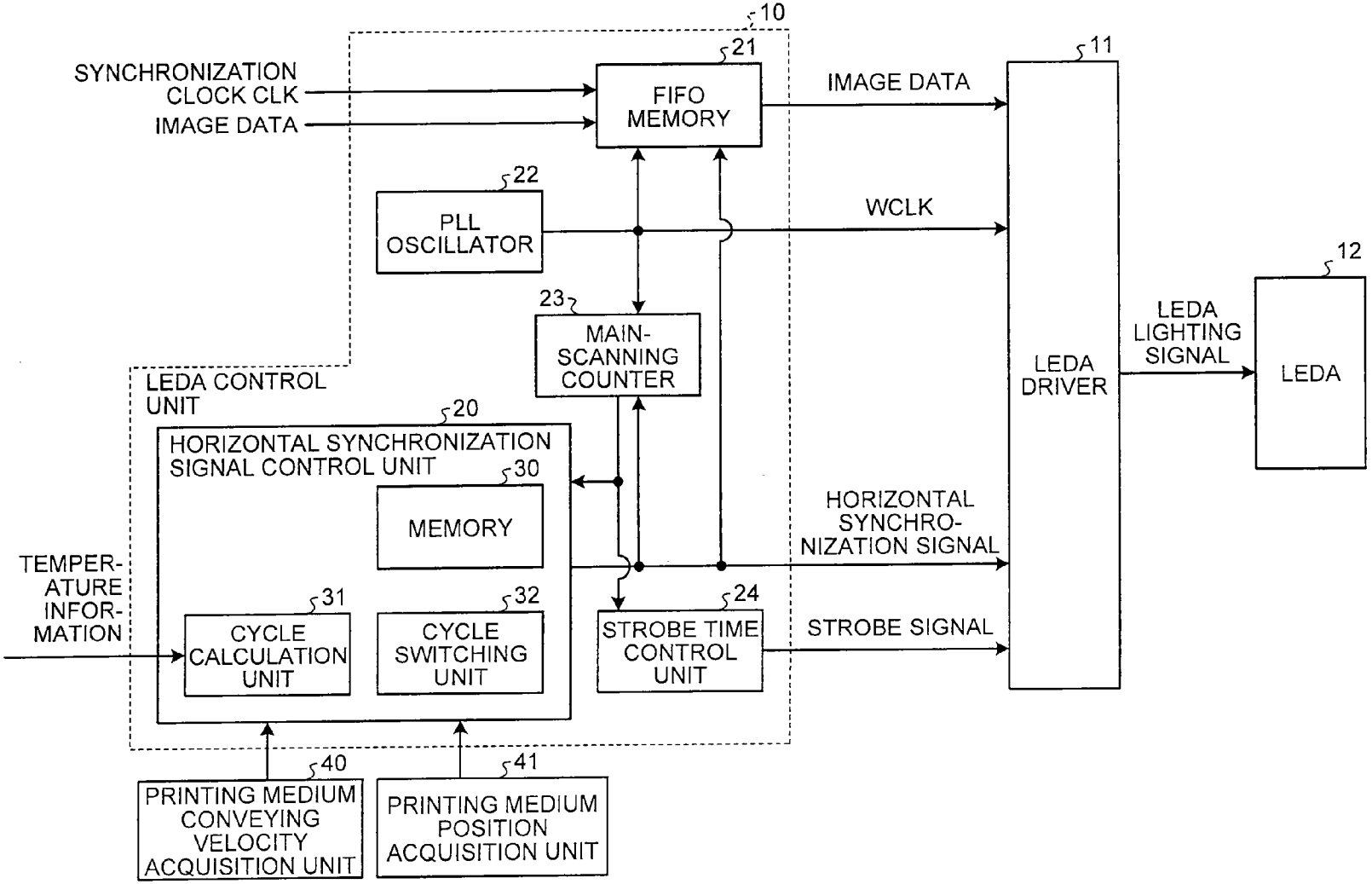
FIG. 6 is a block diagram illustrating an example of a configuration of an LEDA control unit that can change the exposure timing according to the first embodiment.

FIG. 6 illustrates a configuration of an example of an LEDA control unit 10 that can change the exposure timing. This LEDA control unit 10 is provided for each of the LEDA heads 114C, 114M, 114Y, and 114BK. Unless otherwise specified, the LEDA control unit 10 in the LEDA head 114C is described.

The LEDA control unit 10 receives the input of image data for forming an image, and a synchronization clock CLK synchronizing with the image data, and supplies the image data, a writing clock WCLK generated based on the synchronization clock CLK, a horizontal synchronization signal, and a strobe signal to an LEDA driver 11. The LEDA driver 11 generates an LEDA lighting signal in accordance with the writing clock WCLK, horizontal synchronization signal, and strobe signal, and drives an LEDA 12.

A printing medium conveying velocity acquisition unit 40 acquires the conveying velocity of the printing medium (paper 104). The conveying velocity acquired here is the velocity relative to the reference linear velocity $V_1$. For example, the printing medium conveying velocity acquisition unit 40 receives the outputs of the registration sensor 121 and the discharging sensor 122, and acquires the conveying velocity of the paper 109 based on the received outputs. Alternatively, the printing medium conveying velocity acquisition unit 40 may acquire the driving velocity of the conveying belt 105 from a driving unit that drives the driving roller 107, and use the acquired driving velocity as the conveying velocity of the paper 104.

A printing medium position acquisition unit 41 acquires the position of the printing medium. For example, the printing medium position acquisition unit 41 receives the outputs of the registration sensor 121 and the discharging sensor 122, and acquires the timing at which the paper 104 is detected by the registration sensor 121 and the timing at which the paper 104 is detected by the discharging sensor 122 and notifies a horizontal synchronization signal control unit 20.

The LEDA control unit 10 includes the horizontal synchronization signal control unit 20, a FIFO (First In First Out) memory 21, a PLL (Phase Locked Loop) oscillator 22, a main-scanning counter 23, and a strobe time control unit 24.

The PLL oscillator 22 generates the writing clock WCLK with a predetermined frequency using a PLL. The writing clock WCLK is supplied to the LEDA driver 11 and supplied to the FIFO memory 21 and the main-scanning counter 23. The main-scanning counter 23 counts the supplied writing clock WCLK. The main-scanning counter 23 is reset by the horizontal synchronization signal supplied from the horizontal synchronization signal control unit 20. The strobe time control unit 24 controls the strobe signal that determines the lighting period of the LEDA 12 per line in accordance with the counter value supplied from the main-scanning counter 23.

The horizontal synchronization signal control unit 20 outputs the horizontal synchronization signal based on the count value of the main-scanning counter 23. This horizontal synchronization signal is supplied to the FIFO memory 21 and supplied to the LEDA driver 11.

Figure 7:
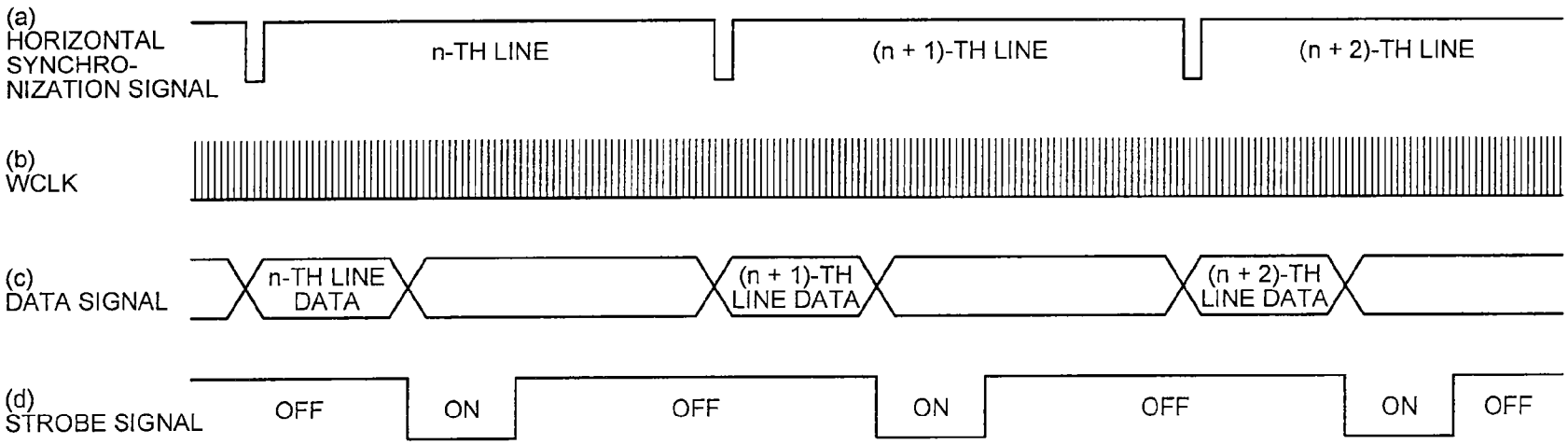
FIG. 7 is a timing chart illustrating an example of each signal output from the LEDA control unit to an LEDA driver.

FIG. 7 illustrates timing charts of an example of each signal output from the LEDA control unit 10 to the LEDA driver 11. Note that FIG illustrates the example in which the exposure timing is not changed. With reference to (a) to (7) in FIG. 7, the basic operation of the exposure timing control is described.

(a) and (b) in FIG. 7 illustrate the examples of the horizontal synchronization signal and the writing clock WCLK, respectively. The horizontal synchronization signal represents the head of main scanning when the signal is in an L state, and defines the time of one line of the main scanning. That is, the horizontal synchronization signal represents the length of one line in the sub-scanning direction. The writing clock WCLK represents the timing of writing for each pixel.

(c in FIG. 7 depicts a data signal by image data for performing the exposure. The image data written in the FIFO memory 21 are read out in the order of main scanning, for example, from the FIFO memory 21 as soon as the horizontal synchronization signal becomes the L state, and supplied to the LEDA driver 11. The LEDA driver 11 sets the supplied image data to a driving unit (not shown) that drives each LED of the LEDA 12, for example.

(d) in FIG. 7 depicts the example of the strobe signal. The LEDA driver 11 makes each LED of the LEDA 12 emit light in accordance with the image data based on the writing clock WCLK in a period where this strobe signal indicates ON.

The sub-scanning magnification correction is performed by changing the cycle of the horizontal synchronization signal generated by the horizontal synchronization signal control unit 20 depicted in (a) in FIG. 7 in response to the linear velocity ratio A between the fixing roller 123*a* and the photosensitive drum 109 to change the exposure timing.

The configuration of the horizontal synchronization signal control unit 20 performing this sub-scanning magnification correction is more specifically described using FIG. 6. The horizontal synchronization signal control unit 20 includes a memory 30, a cycle calculation unit 31, and a cycle switching unit 32.

The memory 30 stores in advance the known information necessary for performing the sub-scanning magnification correction. For example, the reference linear velocity $V_1$ and the coefficient of thermal expansion ρ of the fixing roller 123*a* are stored in the memory 30 in advance as the information used for calculating the linear velocity ratio A. As the information used for estimating the correction period, the distances between the registration sensor 121 and the fixing roller 123*a*, the discharging sensor 122, and the position C at which the transfer by the image forming unit 106C is performed are stored in the memory 30 in advance. Further, as the information used for estimating the correction period, the time and the distance where the photosensitive drum 109C rotates from the exposure position B to the transfer position C, and the size of the paper 104 in the conveying direction are stored in advance. The conveying velocity of the paper 104 may be stored in the memory 30 further.

The cycle calculation unit 31 calculates the period where the sub-scanning magnification correction is performed in accordance with the processing in Step S10 and Step S11 in the flow chart of FIG. 2 based on the conveying velocity supplied from the printing medium conveying velocity acquisition unit 40 and each timing supplied from the printing medium position acquisition unit 41 at which the paper 104 is detected by the registration sensor 121 and the discharging sensor 122. For example, with reference to FIG. 4B, the period 200 from the time point $t_3'$ to the time point $t_6$ is obtained for the (n−1)-th sheet of paper 104.

The cycle calculation unit 31 obtains the linear velocity ratio A between the fixing roller 123*a* and the photosensitive drum 109 in accordance with the formulae (1) to (5) based on the temperature information supplied from a temperature detector, which is not shown, measuring the temperature of the fixing roller 123*a* and on the reference linear velocity $V_1$ and the coefficient of thermal expansion ρ stored in the memory 30. Using the linear velocity ratio A obtained, the above formula (6) is calculated to provide the light exposure timing after the change by the sub-scanning magnification correction.

The cycle calculation unit 31 supplies the obtained information indicating the period performing the sub-scanning magnification correction and the information indicating the exposure timing after the change by the sub-scanning magnification correction to the cycle switching unit 32. The cycle switching unit 32 switches the cycle of the horizontal synchronization signal generated by the horizontal synchronization signal control unit 20 to the cycle that follows the exposure timing indicated by the exposure timing information in the period indicated by the period information.

According to the first embodiment, the exposure timing of the photosensitive drum 109 is changed using as the correction value the linear velocity ratio A between the fixing roller 123*a* and the photosensitive drum 109 in the correction period obtained based on the position and the conveying velocity of the paper 104. Thus, the correction of the sub-scanning magnification deviation can be performed with a simple configuration.

Moreover, since the linear velocity ratio A is obtained based on the temperature of the fixing roller 123*a*, extra hardware such as a sensor for obtaining the linear velocity ratio A is not necessary.

In the printing of only one sheet of paper or printing of the first sheet of paper in continuous printing, the paper 104 is fed from the paper cassette 101 in advance and stored in the registration roller (separating rollers 103 in FIG. 1) for starting the printing promptly. Accordingly, the period for performing the sub-scanning magnification correction as above cannot be acquired in accordance with the timing at which the passage of the paper 104 is detected by the registration sensor 121. In this case, the correction period may be set using software.

For example, the information indicating the timing of the correction start in the case where the position of the registration sensor 121 or the separating rollers 103 is used as the reference position and the paper 104 is conveyed from the reference position at a predetermined velocity is stored in the memory 30 or the like in advance. In the case where the printing of only one sheet of paper is instructed or the first sheet of paper is printed according to the continuous printing instruction, the horizontal synchronization signal control unit 20 controls the cycle switching unit 32 according to the correction start timing information stored in the memory 30 to change the exposure timing in the correction period. The control over the cycle switching unit 32 according to the correction start timing information may be performed by a CPU (Central Processing Unit), which is not shown, controlling the entire image forming device.

First Modified Example of the First Embodiment

Next, a first modified example of the above first embodiment is described. An external shape of the fixing roller 123*a* changes over time due to the heat generated from a heater or the like in some cases. The state of change depends on the material of the fixing roller 123*a*. For example, in the case of using a sponge material, the fixing roller 123*a* contracts over time, so that the external shape is reduced in size. Meanwhile, in the case of using a rubber material, the fixing roller 123*a* expands over time, so that the external shape is increased in size. In accordance with the amount of deformation over time, a difference in linear velocity is caused between the fixing roller 123*a* and the photosensitive drum 109, in which case the sub-scanning magnification deviation is caused.

In view of this, in the first modified example of the first embodiment, the sub-scanning magnification deviation due to the linear velocity difference between the fixing roller 123*a* and the photosensitive drum 109 caused by the change over time is corrected. In other words, in the first modified example, the deformation amount of the fixing roller 123*a* over time is obtained, and the linear velocity ratio A between the fixing roller 123*a* and the photosensitive drum 109 is calculated based on the obtained deformation amount.

The sub-scanning magnification correction on the change of the external shape of the fixing roller 123*a* over time can be performed as follows, for example. The image forming device is provided with an information acquisition unit for acquiring information that represents the change over time, such as the degree of usage (accumulative use time of the fixing roller 123*a* or accumulative number of printed sheets of paper) indicating the frequency of usage of the fixing roller 123*a*, for example, the accumulative usage time of the fixing roller 123*a* or the accumulative number of printed sheets of paper. This information acquisition unit acquires the running distance of the fixing roller 123*a* (operation time of the image forming device) or the number of printed sheets of paper in the image forming device in an accumulative manner, and holds it as the information representing the change over time. Moreover, a correction table in which the information acquired in the information acquisition unit and the correction value of the sub-scanning magnification correction are associated with each other is stored in advance in the memory 30 of the horizontal synchronization signal control unit 20.

In the horizontal synchronization signal control unit 20, the cycle calculation unit 31 obtains the correction value by referring to the correction table stored in the memory 30 for each predetermined value of the information acquired in the information acquisition unit or for each printing, and calculates the exposure timing after the change by the sub-scanning magnification correction based on the obtained correction value. Then, the cycle calculation unit 31 supplies to the cycle switching unit 32, the information indicating the calculated exposure timing after the change by the sub-scanning magnification correction and the information indicating the period where the sub-scanning magnification correction obtained as described in the first embodiment is performed. Based on the supplied period information and exposure timing information, the cycle switching unit 32 switches the cycle of the horizontal synchronization signal generated by the horizontal synchronization signal control unit 20 to the cycle following the exposure timing indicated by the exposure timing information in the period indicated by the period information.

In the first modified example of the first embodiment, the linear velocity ratio A is obtained based on the change of the fixing roller 123*a* over time; therefore, the deterioration in printing image quality due to the change of the image forming device over time can be suppressed.

Second Modified Example of the First Embodiment

Next, a second modified example of the above first embodiment is described. In the above first embodiment, the linear velocity ratio A between the fixing roller 123*a* and the photosensitive drum 109 is obtained based on the temperature of the fixing roller 123*a*, and this linear velocity ratio A is used as the correction value for performing the sub-scanning magnification correction. In contrast, in the second modified example of this first embodiment, the correction value is obtained based on the thickness (hereinafter, paper thickness) of the printing medium to which printing is performed; and in accordance with this correction value, the sub-scanning magnification correction is performed. In other words, the fixing roller 123*a* and the pressing roller 123*b* deform due to the thickness of the paper 104 passing between the fixing roller 123*a* and the pressing roller 123*b*; in accordance with the amount of this deformation, thus a difference in linear velocity is generated between the fixing roller 123*a* and the photosensitive drum 109, thereby causing the sub-scanning magnification deviation.

Figure 8:
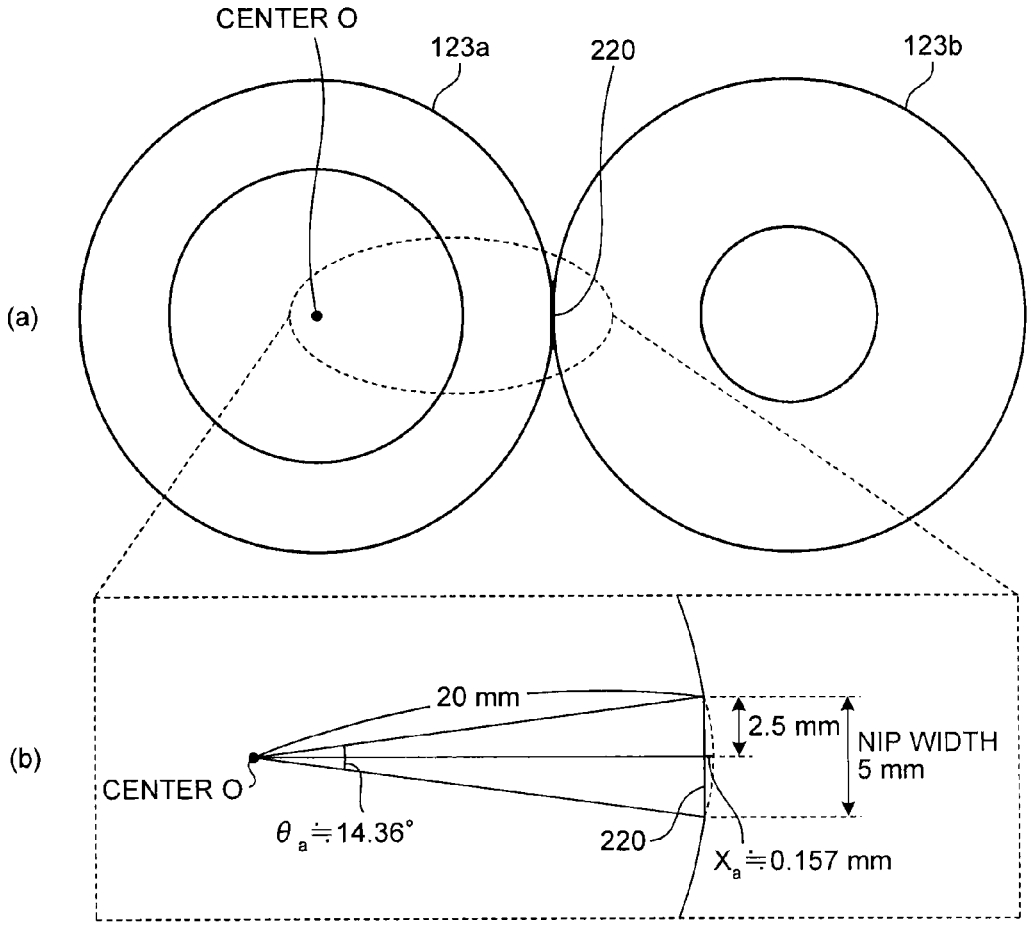
FIG. 8 is a schematic diagram for describing how to obtain the linear velocity of the fixing roller based on paper thickness.
Figure 9:
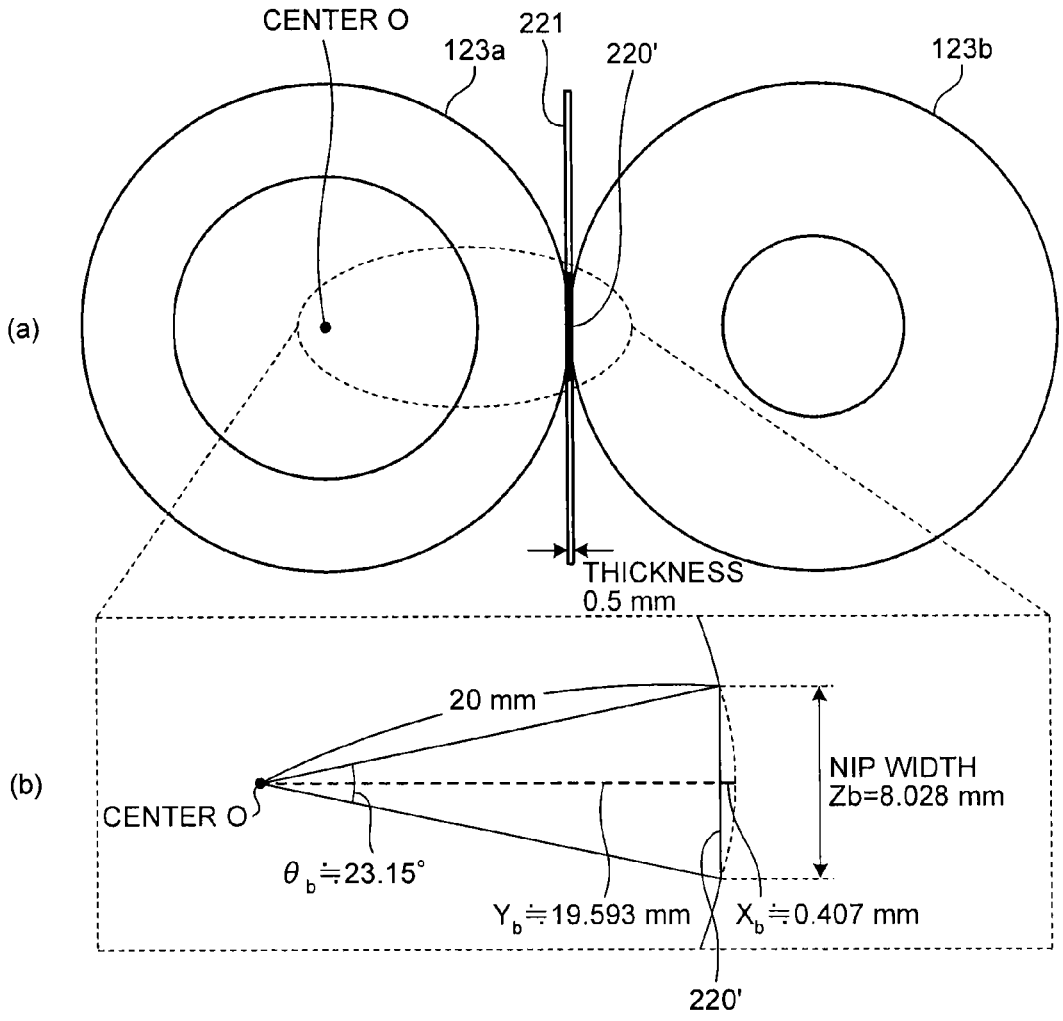
FIG. 9 is a schematic diagram for describing how to obtain the linear velocity of the fixing roller based on paper thickness.
Figure 10:
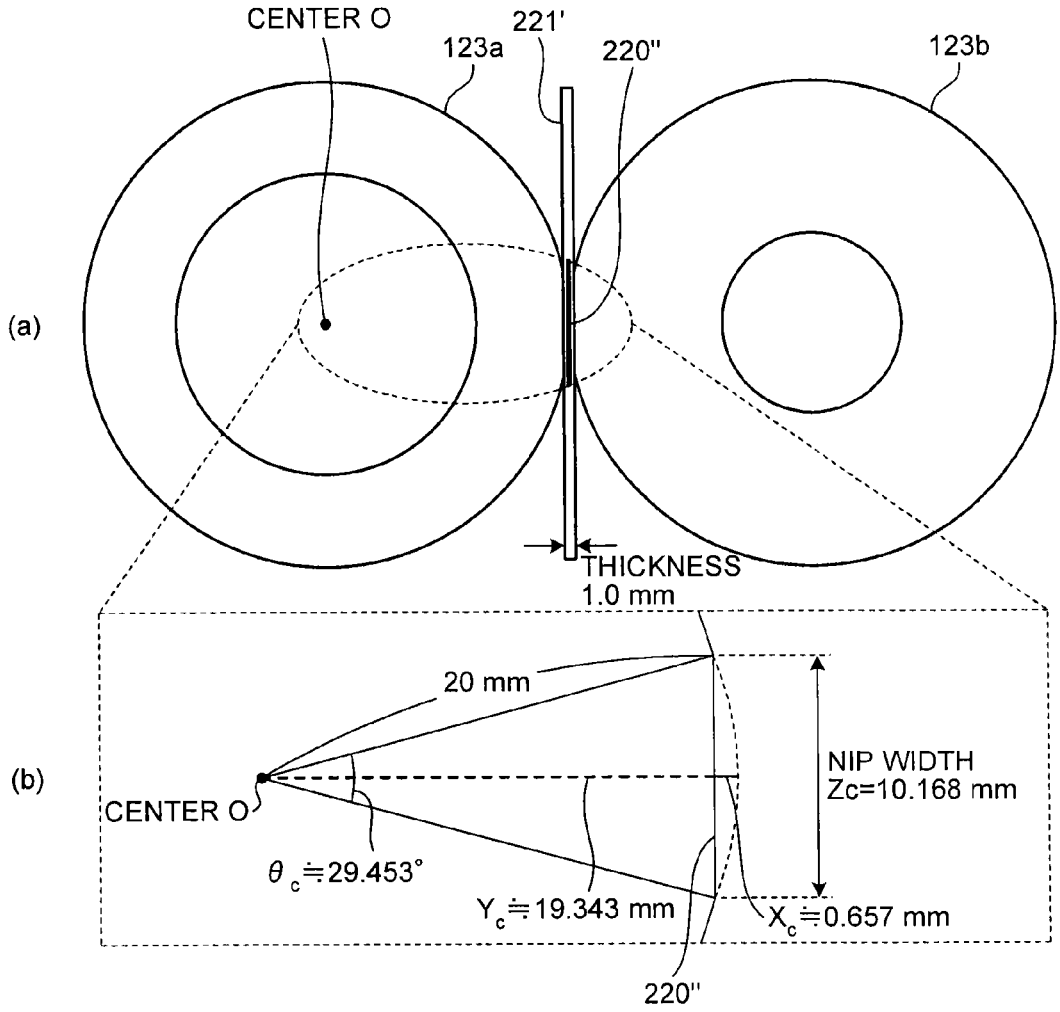
FIG. 10 is a schematic diagram for describing how to obtain the linear velocity of the fixing roller based on paper thickness.

With reference to FIGS. 8 to 10, how to obtain the linear velocity of the fixing roller 123*a* based on the paper thickness is described. FIG. 8 depicts the initial state in which no printing medium exists between the fixing roller 123*a* and the pressing roller 123*b*; FIG depicts the state in which a printing medium 221 with a paper thickness of 0.5 mm exists therebetween; and FIG. 10 depicts the state in which a printing medium 221' with a paper thickness of 1.0 mm exists therebetween.

First, how to calculate the linear velocity of the fixing roller 123*a* in the initial state illustrated in FIG is described. (a) in FIG. 8 depicts schematically the state of the fixing roller 123*a* and the pressing roller 123*b*. In (b) in FIG. 8, a main part of (a) in FIG. 8 (part surrounded by a dotted line) is magnified. In the example of FIG. 8, the linear velocity of the fixing roller 123*a* is 150 mm/s, and this is used as a reference linear velocity $V_{10}$. The width (nip width) of a nip part 220, where the fixing roller 123*a* and the pressing roller 123*b* are in contact with each other, is 5 mm. The radius of the fixing roller 123*a* is 20 mm.

In FIG. 8, the angular velocity $V_a$ of the fixing roller 123*a* for achieving a reference linear velocity $V_{10}$ of 150 mm/s is calculated. First, the angle $\theta_a$ for viewing the nip part 220 from the center O of the fixing roller 123*a* is obtained. Since $\sin(\theta_a/2)=20/2.5$, $\theta_a\approx14.36°$ is obtained. A distance of 5 mm is produced by the rotation of $\theta_a\approx14.36°$; thus, the angular velocity $V_a$ for achieving a linear velocity of 150 mm/s is calculated as the following formula (7).

$$V_a=14.36\times150/5=430.8°/s \tag{7}$$

Here, the length $X_a$ of a deformed portion obtained by deformation through the creation of the nip part 220 and the crush from the original radius of the fixing roller 123*a* is obtained. This value is calculated as $X_a\approx0.157$ mm from the following formula (8) in which Pythagorean theorem is used.

$$X_a=20-(20^2-2.52)^{1/2} \tag{8}$$

Next, the linear velocity of the fixing roller 123*a* in the state where the printing medium 221 with a paper thickness of 0.5 mm exists between the fixing roller 123*a* and the pressing roller 123*b* is calculated using FIGS. 9A and 9B. FIG. 9A schematically illustrates the state of the fixing roller 123*a* and the pressing roller 123*b*. FIG. 93 illustrates the magnified main part of FIG. 9A (portion surrounded by a dotted line). Since the printing medium 221 has a thickness of 0.5 mm, the length $X_b$ of the deformed portion crushed by the deformation of the nip part 220' is calculated by the following formula (9) using the length $X_a$ of the deformed portion in the absence of the printing medium 221.

$$X_b=X_a+0.5/2=0.407 \text{ mm} \tag{9}$$

Using this length $X_b$, the length $Y_b$ is calculated by the following formula (10). The width $Z_b$ of the nip part 220' is calculated by the following formula (11) using this length $Y_b$ according to Pythagorean theorem.

$$Y_b=20-X_b=19.593 \text{ mm} \tag{10}$$

$$Z_b=(20^2-Y_b^2)^{1/2}\times2=8.028 \text{ mm} \tag{11}$$

The angle $\theta_b$ for viewing the nip part 220' is calculated as $\theta_b=23.15°$ because $\cos(\theta_b/2)=Y_b/20$. Using this angle $\theta_b$, the linear velocity $v_b$ of the fixing roller 123*a* is calculated by the following formula (12).

$$v_b=(V_a/\theta_b)\times Z_b=149.4 \text{ mm/s} \tag{12}$$

Next, the linear velocity of the fixing roller 123*a* in the state where the printing medium 221' with a paper thickness of 1.0 mm exists between the fixing roller 123*a* and the pressing roller 123*b* is calculated using FIGS. 10A and 10B. FIG. 10A schematically illustrates the state of the fixing roller 123*a* and the pressing roller 123*b*. FIG. 10B illustrates the magnified main part of FIG. 10A (portion surrounded by a dotted line). Since the printing medium 221 has a thickness of 1.0 mm, the length $X_c$ of a deformed portion crushed by the deformation of a nip part 220" is calculated by the following formula (13) using the length $X_a$ of the deformed portion in the absence of the printing medium 221'.

$$X_c=X_a+1.0/2=0.657 \text{ mm} \tag{13}$$

Using this length $X_c$, the length $Y_c$ is calculated by the following formula (14). The width $Z_c$ of the nip part 220" is calculated by the following formula (15) using this length $Y_c$ according to Pythagorean theorem.

$$Y_c=20-X_c=19.343 \text{ mm} \tag{14}$$

$$Z_c=(20^2-Y_c^2)^{1/2}\times2=10.168 \text{ mm} \tag{15}$$

The angle $\theta_c$ for viewing the nip part 220" is calculated as $\theta_c=29.453°$ because $\cos(\theta_c/2)=Y_c/20$. Using this angle $\theta_c$, the linear velocity $v_c$ of the fixing roller 123*a* is calculated by the following formula (16).

$$v_c=(V_a/\theta_c)\times Z_c=148.7 \text{ mm/s} \tag{16}$$

Figure 11:
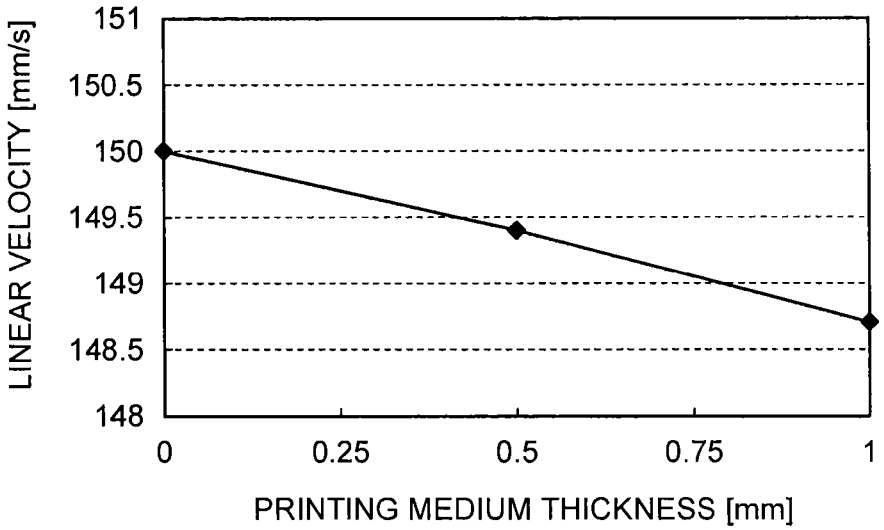
FIG. 11 is a graph in which the linear velocity obtained based on the reference linear velocity and each paper thickness is plotted relative to the paper thickness.

FIG. 11 is a graph in which the reference linear velocity $V_{10}$ and the linear velocities $v_b$ and $v_c$ obtained for the aforementioned paper thicknesses of 0.5 mm and 1.0 mm are plotted relative to the paper thicknesses. It is understood that as the paper thickness is increased, the deformation of the fixing roller 123*a* is increased and the linear velocity is decreased.

Figure 12:
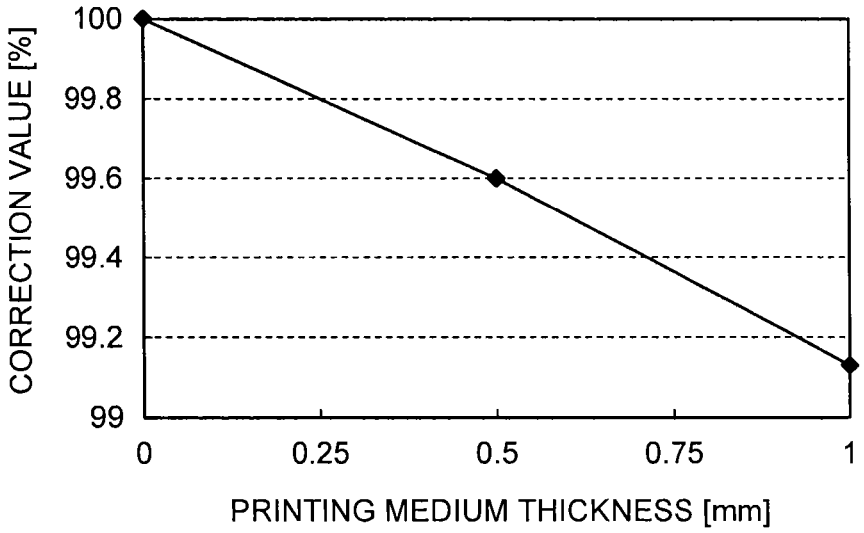
FIG. 12 is a graph in which the correction value for the sub-scanning magnification correction at each paper thickness is plotted relative to the paper thickness.

FIG. 12 is a graph in which the linear velocity ratio A is calculated for each paper thickness based on each of the linear velocities $v_b$ and $v_c$ for each paper thickness, and this is used as the correction value for the sub-scanning magnification correction to be plotted relative to the paper thicknesses. In this example, the correction value at a paper thickness of 0.5 mm is $v_b/V_{10}=99.6\%$, and the correction value at a paper thickness of 1.0 mm is $v_c/V_{10}=99.1\%$.

The relation between the correction value and the paper thickness exemplified in FIG. 12 is created in advance as a table; and at the time of printing, the information of the paper thickness of the printing medium is acquired and this table is referred to depending on the acquired paper thickness, so that the correction value relative to the paper thickness, i.e., the linear velocity ratio A is acquired. Then, the exposure timing after the change is obtained according to the above formula (6), and in the period obtained separately in which the sub-scanning correction is necessary, the cycle of the horizontal synchronization signal is changed.

Figure 13:
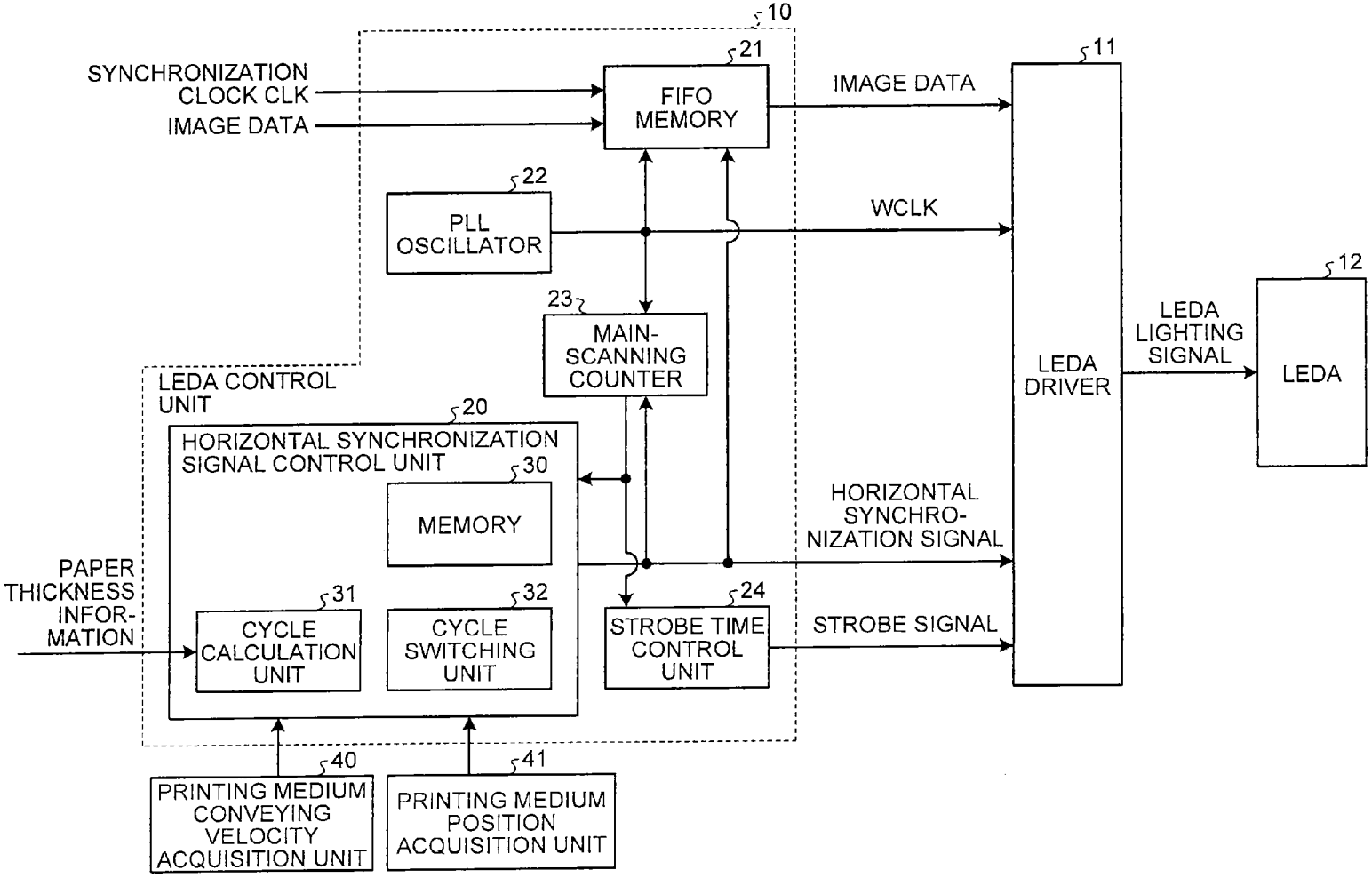
FIG. 13 is a block diagram illustrating a configuration of an example of an LEDA control unit according to a second modified example of the first embodiment.

FIG. 13 illustrates the configuration of an example of the LEDA control unit 10 in a second modified example of the first embodiment. The component in FIG. 13 which is common to that of FIG. 6 above is denoted with the same reference symbol and the detailed description thereof is omitted.

To the horizontal synchronization signal control unit 20, the paper thickness information indicating the paper thickness is supplied. As for the paper thickness, a sensor detecting the paper thickness can be provided for a feed path of the paper 104 or the like; and the output of this sensor can be supplied as the paper thickness information. Alternatively, the paper thickness may be input from an operation panel, which is not shown, or the paper thickness may be stored in advance in the memory 30 as a fixed value.

In the horizontal synchronization signal control unit 20, each piece of information for estimating the aforementioned correction period is stored in advance in the memory 30; and moreover, the table described using FIG. 12 in which the paper thickness and the correction value are associated with each other is stored in the memory 30 in advance. The cycle calculation unit 31 obtains the correction value relative to the paper thickness indicated by the paper thickness information referring to the table according to the supplied paper thickness information. Then, calculation corresponding to the aforementioned formula (6) is performed using the obtained correction value; and the exposure timing after the change by the sub-scanning magnification correction is calculated.

The cycle calculation unit 31 supplies to the cycle switching unit 32, the information indicating the period obtained separately as described in the first embodiment for performing the sub-scanning magnification correction, and the information indicating the exposure timing after the change by the sub-scanning magnification correction. Based on the supplied period information and exposure timing information, the cycle switching unit 32 switches the cycle of the horizontal synchronization signal generated by the horizontal synchronization signal control unit 20 to the cycle following the exposure timing indicated by the exposure timing information in the period indicated by the period information.

The correction value is obtained by referring to the table in which the correction value and the paper thickness stored in the memory 30 are associated with each other in the above description; however, the present invention is not limited to this. For example, the cycle calculation unit 31 may have a function of calculating the correction value based on the paper thickness, so that the correction value for the sub-scanning magnification correction may be calculated based on the supplied paper thickness information.

In the second modified example of the first embodiment, the correction value for performing the sub-scanning magnification correction is obtained according to the paper thickness of the paper 104 in this manner, so that this example can be applied to various printing media.

Note that the first embodiment, the first modified example of the first embodiment, and the second modified example of the first embodiment are described so that they are independently carried out; however, the present invention is not limited thereto. That is, the first embodiment, the first modified example of the first embodiment, and the second modified example of the first embodiment can be carried out in combination.

Second Embodiment

Next, a second embodiment is described. The above first embodiment has described the example in which the image forming device of the direct transfer type where the image forming units 106C, 106M, 106Y, and 106BK directly transfer the images to the paper 104. In contrast, in the second embodiment, the image forming device of the intermediate transfer type in which the image forming units 106C, 106M, 106Y, and 106BK transfer the images to the intermediate transfer belt; and the images transferred to the intermediate transfer belt are further transferred to the paper 104.

Figure 14:
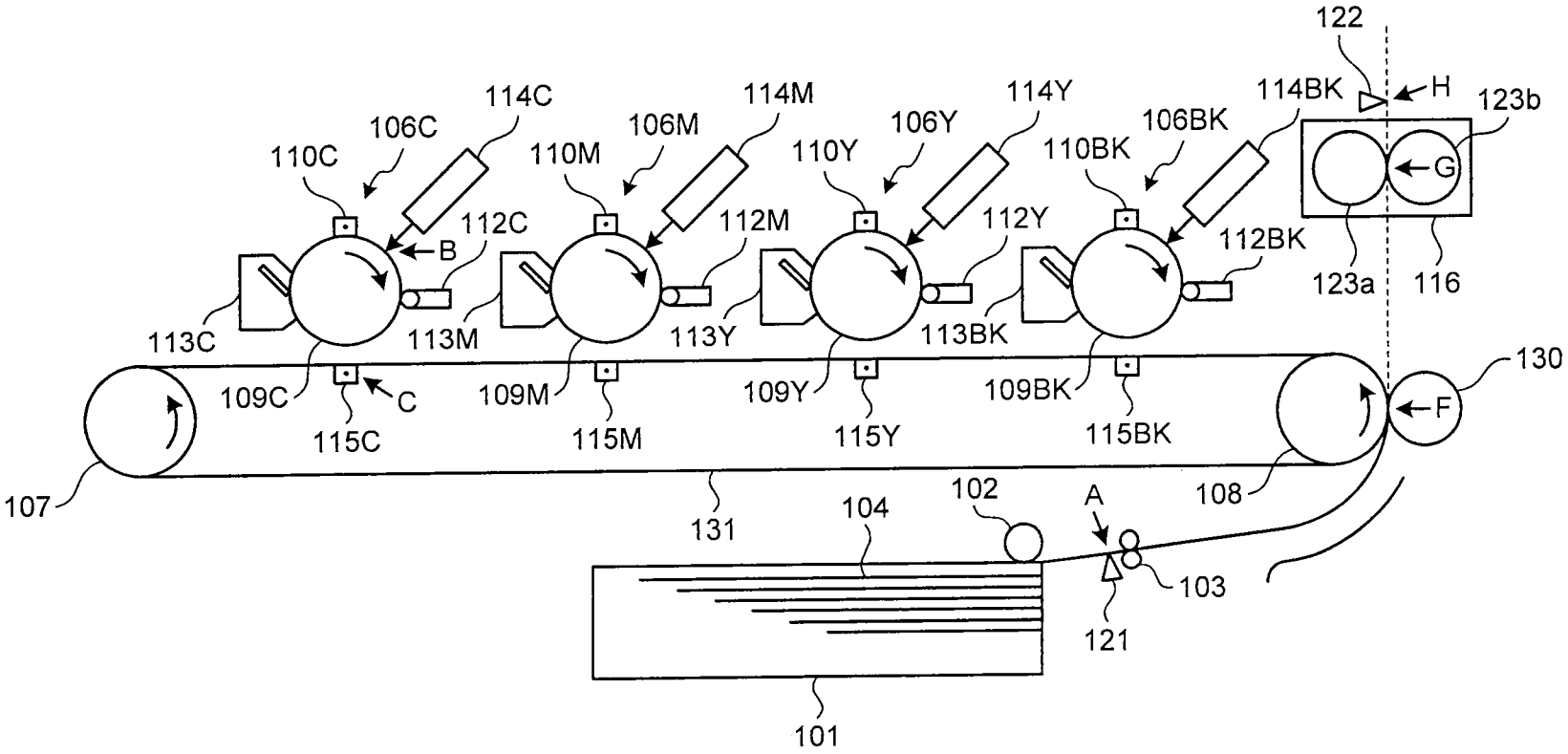
FIG. 14 is a schematic diagram basically illustrating the unit performing image formation in a configuration of an example of an image forming device according to a second embodiment.

FIG. 14 mainly illustrates the units for forming the image in the configuration of an example of the image forming device according to the second embodiment. A component of FIG. 14 which is common to that of FIG. 1 above is denoted with the same reference symbol and the detailed description thereof is omitted.

An intermediate transfer belt 131 is wound around the driving roller 107 and the driven roller 108 in a manner similar to the above conveying belt 105, and is rotated and driven by a driving motor, which is not shown. The image forming units 106BK, 106Y, 106M, and 106C are arranged in the order from the upstream side in the driving direction of the intermediate transfer belt 131. Each of the toner images formed on the photosensitive drums 109BK, 109Y, 109M, and 109C in the image forming units 106BK, 106Y, 106M, and 106C is transferred to the intermediate transfer belt 131 by each of the transferring units 115BK, 115Y, 115M, and 115C while the images of the colors are overlapped on each other.

The paper 104 is extracted from the paper cassette 101 by the paper feeding roller 102, and sent from the separating rollers 103, so that the paper 104 reaches a secondary transfer roller 130. The conveyance of the paper 104 to the secondary transfer roller 130 is controlled so that the toner image transferred to the intermediate transfer belt 131 is transferred to the paper 104 by the secondary transfer roller 130 (secondary transfer). The paper 104 is sent to the fixer 116 after the toner image on the intermediate transfer belt 131 is transferred to the paper 104 by the secondary transfer roller 130. Upon the reach of the paper 104 at the fixer 116, the toner image is fixed by the fixing roller 123*a* and the pressing roller 123*b*, and is discharged.

Since the same configuration as the first embodiment described using FIG. 6 can be employed as the configuration of the LEDA control unit 10, the description here is omitted.

Even in this intermediate transfer type, when the linear velocity of the fixing roller 123*a* and the linear velocity of the photosensitive drum 109 are different, the sub-scanning magnification deviation occurs like in the aforementioned direct transfer type. Accordingly, for correcting this sub-scanning magnification deviation, the sub-scanning magnification correction is performed. The correction value for the sub-scanning magnification correction is obtained based on the deformation amount of the fixing roller 123*a* in a manner similar to the first embodiment, the first modified example of the first embodiment, and the second modified example of the first embodiment above.

For example, in a manner similar to the above first embodiment, the linear velocity ratio A between the fixing roller

123*a* and the photosensitive drum 109 is obtained based on the temperature of the fixing roller 123*a* and this linear velocity ratio A is used as the correction value. Alternatively, the correction value for the sub-scanning magnification correction may be obtained based on the change of the fixing roller 123*a* over time like in the first modified example of the first embodiment, or based on the paper thickness of the paper 104 like in the second modified example of the first embodiment. Further alternatively, the correction value may be obtained using the combination of the temperature and the change over time of the fixing roller 123*a* and the paper thickness of the paper 104.

Meanwhile, how to acquire the period for performing the sub-scanning magnification correction is different in the above first embodiment and the second embodiment. FIGS. 15A to 15F illustrate time-sequentially the states of one example of each position in the case where the paper 104 is conveyed according to the second embodiment. In this example, the paper 104 including the (n−2)-th, the (n−1)-th, the n-th, . . . sheets of paper are conveyed continuously with a predetermined paper space. Here, the paper size in the conveying direction of the paper 104 and the size of an image region of the paper 104 to which the image is transferred in the conveying direction are the same as each other. Moreover, the description is hereinafter made paying attention to the image formation in the image forming unit 106C.

Figure 15:
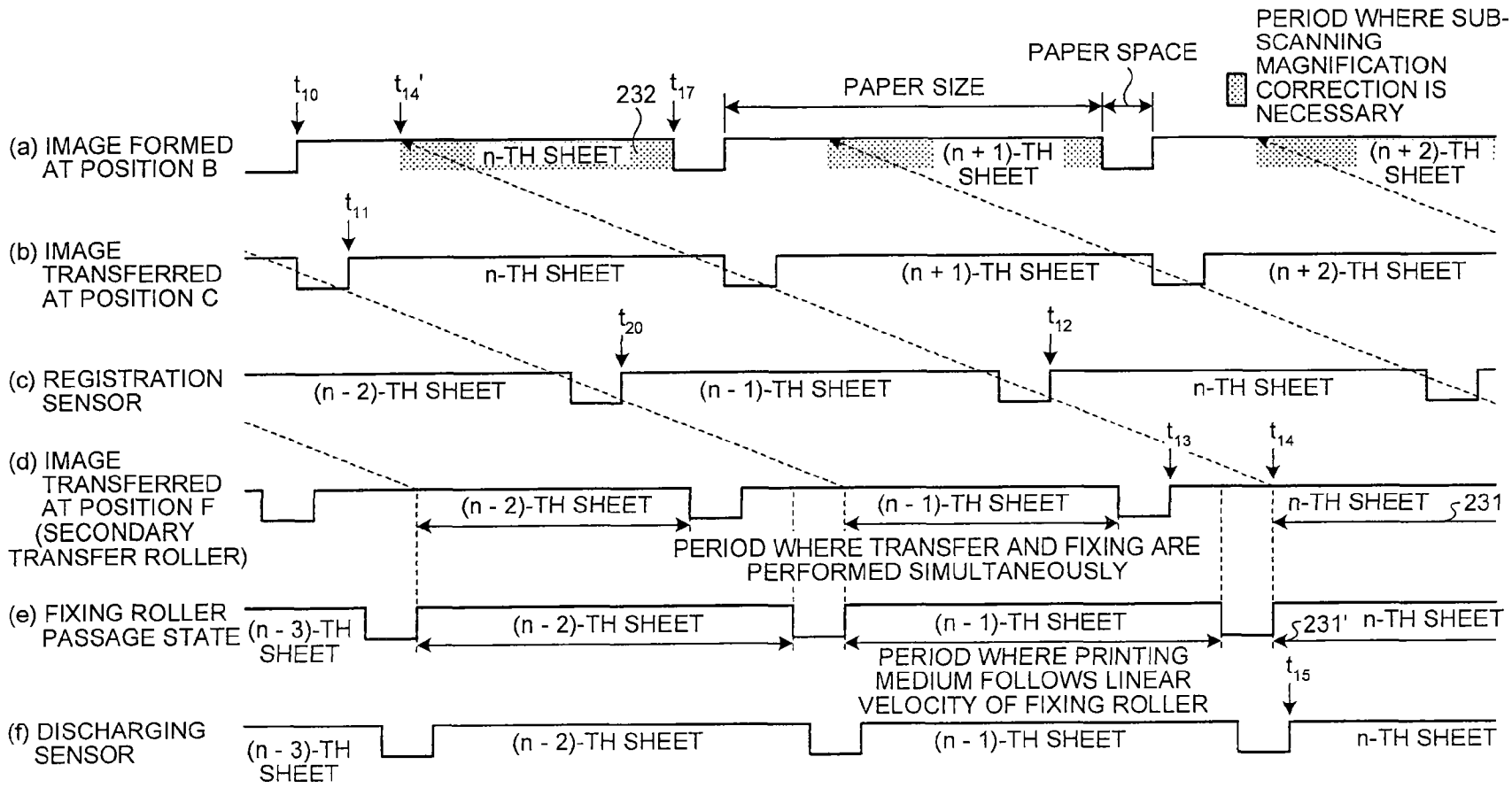
FIG. 15 is a schematic diagrams illustrating time-sequentially the state of an example of each position in the conveyance of the paper according to the second embodiment.

(a) in FIG. 15 indicates the timing at which the image is formed by exposing the photosensitive drum 109C to light at the position B. (b) in FIG. 15 indicates the timing at which the image formed at the position B is transferred to the paper 104 at the position C. (c) in FIG. 15 indicates the state of the paper 104 at the position A, i.e., the example of the output of the registration sensor 121. (d) in FIG. 15 indicates the timing at which the image is transferred at the position F by the secondary transfer roller 130. (E) in FIG. 15 indicates the timing at which the paper 104 passes the position G, i.e., passes the fixing roller 123*a*. Moreover, FIG. 15F indicates the timing at which the paper 104 is detected by the discharging sensor 122.

In the intermediate transfer type, the toner image transferred to the intermediate transfer belt 131 reaches the position of the secondary transfer roller 130 after driving of approximately one round of the intermediate transfer belt 131. Therefore, the transfer of the toner image for the n-th sheet of paper 104 to the intermediate transfer belt 131 is performed before the start of the conveyance of the paper 104, for example.

At a time point $t_{10}$, the image formation to the photosensitive drum 109C for the n-th sheet of paper 104 at the position B is started, and at a time point $t_{11}$ after the rotation of the photosensitive drum 109C from the position B to the position C, the formed image is transferred to the intermediate transfer belt 131 at the position C. At the time point $t_{11}$, the (n−2)-th sheet of paper 104 is still passing the position of the registration sensor 121. Moreover, at the time point $t_{11}$, the transfer of the image to the intermediate transfer belt 131 for the (n−1)-th sheet of paper 104 already ends.

At a time point $t_{20}$, the conveyance of the (n−1)-th sheet of paper 104 is started, and then the conveyance of the n-th sheet of paper 104 is started. At a time point $t_{12}$, the head of the n-th sheet of paper 104 is detected by the registration sensor 121. The n-th sheet of paper 104 is sent from the separating rollers 103 and reaches the position F at a time point $t_{13}$, and the image on the intermediate transfer belt 131 is transferred to the n-th sheet of paper 104 by the secondary transfer roller 130. In other words, the transfer of the image, which has been transferred onto the intermediate transfer belt 131 at the time point $t_{11}$, to the n-th sheet of paper 104 is started from the time point $t_{13}$.

The n-th sheet of paper 104 is sent from the secondary transfer roller 130 while the image is transferred to the secondary transfer roller 130, and is sent to the fixing roller 123*a* at a time point $t_{14}$ and reaches the position G, so that the toner image is fixed to the paper 104 by the fixing roller 123*a* and the pressing roller 123*b*. Then, at a time point $t_{15}$ right after that, the n-th sheet of paper 104 is detected by the discharging sensor 122 (position H). In a period 231' from this time point $t_{15}$ to a time point $t_{16}$ (not shown) at which the end of the paper 104 passes the fixing roller 123*a*, the paper 104 is conveyed at the linear velocity of the fixer 116.

Here, when the distance from the position F to the position G is shorter than the paper size of the paper 104, the secondary transfer of the image is done for the n-th sheet of paper 104 at the position F at the time point $t_{14}$ at which the n-th sheet of paper 104 has reached the position G. In other words, the n-th sheet of paper 104 in the middle of image transfer is conveyed at the linear velocity of the fixing roller 123*a* in a period 231 from the time point $t_{14}$ to the time point $t_{16}$ at which the end of the paper 104 passes the fixing roller 123*a*. Thus, when the linear velocity of the fixing roller 123*a* and the linear velocity of the secondary transfer roller 130 are different, the line intervals of the image transferred to the intermediate transfer belt 131 is different from the original line intervals, resulting in the sub-scanning magnification deviation.

Therefore, correction for the sub-scanning magnification deviation needs to be performed from a time point $t_{14}'$, which is before the time point $t_{14}$, at which the exposure of the image transferred to the n-th sheet of paper 104 is performed, by the amount of time of driving rotation of the intermediate transfer belt 131 from the position C to the position F and the amount of time of rotation of the photosensitive drum 109 from the position B to the position C. Thus, for the photosensitive drum 109C, a period 232 from the time point $t_{14}'$ to a time point $t_{17}$ corresponds to the period where the sub-scanning magnification correction is necessary.

Note that the images of the colors C, M, Y, and BK are formed on the intermediate transfer belt 131 while the images are overlapped on each other. Therefore, the period in which the sub-scanning magnification correction is necessary is provided for each of the photosensitive drums 109C, 109M, 109Y, and 109BK of the colors C, M, Y, and BK. The periods for the photosensitive drums 109M, 109Y, and 109BK are provided shifted from the above period 232 provided for the photosensitive drum 109C in accordance with each position and the driving velocity of the intermediate transfer belt 131.

The time point $t_{14}$ can be obtained from the timing at which the paper 104 is detected by the registration sensor 121. For example, the time point $t_{14}$ for each sheet of paper 104 is estimated based on the conveying velocity of the paper 104 by the secondary transfer roller 130 and the conveying distance from the registration sensor 121 to the position F (secondary transfer roller 130), which are the known information. Similarly, since the time corresponding to the rotation of the photosensitive drum 109C from the position B to the position C and the conveying time of the secondary transfer belt 131 from the position C to the position F are known, the time point $t_{14}'$ as the correction start timing can be estimated from the time point $t_{14}$.

In the LEDA control unit 10, the cycle calculation unit 31 supplies to the cycle switching unit 32, the information indicating the period for performing the sub-scanning magnification correction obtained thus and the information indicating the exposure timing after the change by the sub-scanning magnification correction. Based on the supplied period information and exposure timing information, the cycle switching unit 32 switches the cycle of the horizontal synchronization signal generated by the horizontal synchronization signal control unit 20 to the cycle following the exposure timing indicated by the exposure timing information in the period indicated by the period information.

Thus, the sub-scanning magnification correction according to the embodiment is applicable to the image forming device of the intermediate transfer type.

Note that in the first embodiment, the first and second modified examples of the first embodiment, and the second embodiment above, the image forming units 106C, 106M, 106Y, and 106BK expose the photosensitive drums 109C, 109M, 109Y, and 109BK to light using the LEDA 12; however, the embodiment is not limited to this. For example, in the image forming units 106C, 106M, 106Y, and 106BK, an organic EL (Electro-Luminescence) element may be used instead of the LEDA as the light-emitting element emitting exposure light. In this case, the configuration can be approximately common except that the LEDA is replaced by the organic EL element as the light-emitting element.

Moreover, in the above embodiments and the modified examples, the image forming units 106C, 106M, 106Y, and 106BK form the image on the paper 104 by transferring the toner images formed on the photosensitive drums 109C, 109M, 109Y, and 109BK to the paper 104; however, the embodiment is not limited to this. For example, the image forming units 106C, 106M, 106Y, and 106BK may employ an ink jet method in which image formation is performed on the paper 104 by discharging ink.

Note that the ink jet type image forming device, in which a fixer is generally unused, might cause the change of linear velocity of a discharge roller discharging the paper 104 due to the deterioration of the discharge roller, difference in paper thickness, and the like. In this case, in a manner similar to the case in which the photosensitive drum and the fixer are used, the conveying velocity of the paper relative to the ink discharge cycle is deviated, thereby causing the sub-scanning magnification deviation. Accordingly, when the embodiment is applied to the inkjet type image forming device to perform the sub-scanning magnification correction, the image quality can be improved.

According to the embodiment, an effect is provided in which the magnification deviation in the sub-scanning direction in the case where the conveying velocity of the printing medium changes relative to the linear velocity of the image forming unit can be corrected with a simpler configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming device comprising:

an image forming unit forming an image on a printing medium in a predetermined cycle in a direction orthogonal to a conveying direction of the printing medium;

a velocity acquisition unit acquiring a conveying velocity of the printing medium at a position where the image is formed by the image forming unit; and a correcting unit correcting the cycle on which the image forming unit forms the image on the printing medium in accordance with the conveying velocity acquired by the velocity acquisition unit, wherein the image forming unit comprises:

an exposing unit exposing an image carrier, rotating in a direction parallel to the conveying direction of the printing medium, to light in the predetermined cycle in a direction orthogonal to the conveying direction and with a certain exposure timing; and a transferring unit forming the image on the printing medium by transferring to the printing medium the image based on a latent image formed by exposing the image carrier to light by the exposing unit, wherein the correcting unit corrects the cycle on which the transferring unit forms the image on the printing medium by changing the certain exposure timing only during a certain time period within a time when the transferring unit forms the image on the printing medium, the certain time period being less than an entirety of the time when the transferring unit forms the image on the printing medium.

2. The image forming device according to claim 1, further comprising a deformation amount detecting unit that is provided on a rear side of a formation position where the image is formed by the image forming unit, relative to the conveying direction and that detects a deformation amount of a roller that feeds the printing medium, wherein the velocity acquisition unit obtains the conveying velocity using the deformation amount detected by the deformation amount detecting unit.

3. The image forming device according to claim 2, wherein the deformation amount detecting unit obtains the deformation amount based on a temperature of the roller.

4. The image forming device according to claim 2, wherein the deformation amount detecting unit obtains the deformation amount based on a degree of usage of the roller.

5. The image forming device according to claim 2, wherein the deformation amount detecting unit obtains the deformation amount based on a thickness of the printing medium.

6. The image forming device according to claim 1, further comprising a position acquisition unit acquiring a position of the printing medium, wherein the correcting unit corrects the cycle at a timing estimated from the position of the printing medium acquired by the position acquisition unit.

7. The image forming device according to claim 6, wherein the position acquisition unit is of a registration sensor detecting the printing medium for positioning the printing medium.

8. The image forming device according to claim 7, wherein the correcting unit estimates the timing of correcting the cycle based on a timing at which the position acquisition unit has acquired the position of the printing medium.

9. The image forming device according to claim 7, wherein the deformation amount detecting unit obtains the deformation amount based on a temperature of the roller.

10. The image forming device according to claim 7, wherein the deformation amount detecting unit obtains the deformation amount based on a degree of usage of the roller.

11. The image forming device according to claim 7, wherein the deformation amount detecting unit obtains the deformation amount based on a thickness of the printing medium.

12. The image forming device according to claim 6, wherein the correcting unit estimates the timing of correcting the cycle based on a timing at which the position acquisition unit has acquired the position of the printing medium.

13. The image forming device according to claim 6, wherein the deformation amount detecting unit obtains the deformation amount based on a temperature of the roller.

14. The image forming device according to claim 6, wherein the deformation amount detecting unit obtains the deformation amount based on a degree of usage of the roller.

15. The image forming device according to claim 6, wherein the deformation amount detecting unit obtains the deformation amount based on a thickness of the printing medium.

16. An image forming device comprising:

an image forming unit forming an image in a predetermined cycle in a direction orthogonal to a conveying direction of a printing medium;

a velocity acquisition unit acquiring a conveying velocity of the printing medium at a first position where the image is formed by the image forming unit and the printing medium is conveyed in a conveying direction by a first conveying element, and at a second position spaced downstream from the first position in the conveying direction by a distance such that the printing medium is simultaneously conveyed by both the first conveying element and a second conveying element during a certain time period; and a correcting unit correcting the cycle on which the image forming unit forms the image in accordance with a difference in the conveying velocities acquired by the velocity acquisition unit at the first position and the second position, wherein the image forming unit comprises:

an exposing unit exposing an image carrier rotating in a direction parallel to the conveying direction of the printing medium to light in a predetermined cycle in a direction orthogonal to the conveying direction and with a certain exposure timing; and a transferring unit forming the image on the printing medium by transferring to the printing medium the image based on a latent image formed by exposing the image carrier to light by the exposing unit, wherein the correcting unit corrects the cycle on which the transferring unit forms the image by changing the certain exposure timing only during said certain time period.

* * * * *